US010121571B1

(12) United States Patent
McNutt et al.

(10) Patent No.: US 10,121,571 B1
(45) Date of Patent: Nov. 6, 2018

(54) COMMUNICATIONS CABLES INCORPORATING SEPARATOR STRUCTURES

(71) Applicant: Superior Essex International LP, Atlanta, GA (US)

(72) Inventors: Christopher W. McNutt, Woodstock, GA (US); Amir Sekhavat, Marietta, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 15/252,775

(22) Filed: Aug. 31, 2016

(51) Int. Cl.
*H01B 11/06* (2006.01)
*H01B 7/02* (2006.01)

(52) U.S. Cl.
CPC ..... *H01B 11/06* (2013.01); *H01B 7/0216* (2013.01)

(58) Field of Classification Search
USPC ..... 174/660, 72 A, 113 R; 701/102
See application file for complete search history.

(56) References Cited

U.S. PATENT DOCUMENTS 1,389,143 A * 8/1921 Kempton ..... B29C 53/566 138/141
2,538,019 A 1/1951 Edwin
2,796,463 A 6/1957 Mallindrodt
3,090,825 A 5/1963 Volk
3,135,935 A 6/1964 Eugelbrecht
3,312,774 A 4/1967 Drinko
3,373,475 A 3/1968 Peterson
3,612,744 A 10/1971 Thomas
4,165,442 A 8/1979 Gabriel
4,239,319 A * 12/1980 Gladd ..... H01R 13/6641 439/620.21
4,604,497 A 8/1986 Bell et al.
4,638,272 A 1/1987 Ive
4,746,767 A 5/1988 Gruhn
4,784,462 A * 11/1988 Priaroggia ..... G02B 6/4407 264/1.28
4,807,962 A * 2/1989 Arroyo ..... G02B 6/4407 385/105

(Continued)

FOREIGN PATENT DOCUMENTS

EP 0915486 11/1998
EP 1632957 5/2005

(Continued)

OTHER PUBLICATIONS

"Product Catalogue" 2 pages, Enterprise Cabling R&M, May 2006.

(Continued)

*Primary Examiner* — William H Mayo, III
*Assistant Examiner* — Krystal Robinson

(57) ABSTRACT

A cable may include a plurality of longitudinally extending twisted pairs of individually insulated conductors. A longitudinally extending separator may be positioned between the plurality of twisted pairs. The separator may include at least one portion that extends beyond and is wrapped at least partially around an outer periphery of the plurality of twisted pairs. The at least one extending portion may have a variable thickness or one or more ribs may be formed on a surface of the extending portion. Additionally, a jacket may be formed around the plurality of twisted pairs and the separator.

20 Claims, 11 Drawing Sheets

(56) References Cited

U.S. PATENT DOCUMENTS 4,874,908 A * 10/1989 Johansson ..... H01B 7/0045 174/72 A
4,881,642 A 11/1989 Adam
5,006,806 A 4/1991 Rippingale
5,008,489 A 4/1991 Weeks et al.
5,106,175 A 4/1992 Davis et al.
5,114,517 A 5/1992 Rippingale et al.
5,177,809 A * 1/1993 Zeidler ..... G02B 6/4403 385/105
5,789,711 A * 8/1998 Gaeris ..... H01B 11/02 174/113 C
5,952,615 A 9/1999 Prudhon
5,956,445 A 9/1999 Deitz et al.
6,222,130 B1 4/2001 Gareis
6,248,954 B1 * 6/2001 Clark ..... H01B 11/04 174/113 R
6,288,340 B1 * 9/2001 Arnould ..... H01B 11/085 174/113 R
6,297,454 B1 10/2001 Gareis
6,310,295 B1 10/2001 Despard
6,506,976 B1 1/2003 Neveux, Jr.
6,570,095 B2 5/2003 Clark et al.
6,596,944 B1 * 7/2003 Clark ..... H01B 11/06 174/113 C
6,624,359 B2 9/2003 Bahlmann
6,639,152 B2 * 10/2003 Glew ..... G02B 6/4435 174/113 C
6,687,437 B1 * 2/2004 Starnes ..... G02B 6/4416 174/113 R
6,723,925 B2 4/2004 Ohara et al.
6,737,574 B2 5/2004 Sylvia et al.
6,770,819 B2 8/2004 Patel
6,800,811 B1 * 10/2004 Boucino ..... H01B 11/06 174/113 C
6,812,408 B2 11/2004 Clark et al.
6,850,161 B1 2/2005 Elliott
6,879,761 B2 * 4/2005 Rogers ..... G02B 6/4404 385/114
6,888,070 B1 5/2005 Prescott
7,098,405 B2 8/2006 Glew
7,135,641 B2 11/2006 Clark
7,173,189 B1 * 2/2007 Hazy ..... H01B 11/04 174/110 R
7,179,999 B2 2/2007 Clark et al.
7,196,271 B2 3/2007 Cornibert
7,238,886 B2 7/2007 Wiekhorst et al.
7,329,815 B2 2/2008 Kenny et al.
7,332,676 B2 2/2008 Sparrowhawk
7,335,837 B2 2/2008 Pfeiler et al.
7,696,438 B2 * 4/2010 Clark ..... H01B 7/184 174/113 AS
7,705,244 B2 * 4/2010 Fok ..... H01B 11/06 174/113 AS
7,834,271 B2 11/2010 Gromko et al.
7,923,632 B2 4/2011 Smith et al.
7,964,797 B2 6/2011 Clark et al.
8,119,907 B1 2/2012 McNutt
8,313,346 B2 11/2012 Sparrowhawk
8,445,787 B2 5/2013 Nordin et al.
8,525,030 B2 9/2013 Wiekhorst et al.
8,558,115 B2 10/2013 Jenner et al.
8,624,116 B2 1/2014 Wiekhorst et al.
8,912,436 B2 * 12/2014 Gabriel ..... H04B 3/00 174/34
9,136,043 B2 9/2015 Brown
9,336,928 B2 5/2016 Wiekhorst et al.
2003/0111241 A1 * 6/2003 Bahlmann ..... H01B 11/06 174/367
2003/0217863 A1 11/2003 Clark et al.
2003/0230427 A1 12/2003 Gareis
2004/0035603 A1 2/2004 Clark
2004/0055781 A1 * 3/2004 Cornibert ..... H01B 11/06 174/135
2005/0103518 A1 * 5/2005 Glew ..... G02B 6/4459 174/113 R
2006/0048961 A1 3/2006 Pfeiler et al.
2006/0131057 A1 6/2006 Lique
2007/0037419 A1 2/2007 Sparrowhawk
2007/0044995 A1 3/2007 Park
2007/0193769 A1 8/2007 Clark
2007/0224495 A1 9/2007 Gibbons et al.
2007/0275583 A1 11/2007 McNutt
2008/0255435 A1 10/2008 Al-Ali et al.
2008/0264670 A1 10/2008 Glew
2008/0314636 A1 12/2008 Ogura
2009/0198856 A1 * 8/2009 Habben ..... H04L 12/40032 710/305
2010/0258333 A1 * 10/2010 Horan ..... H01B 11/1091 174/78
2011/0147039 A1 6/2011 Smith et al.
2013/0008684 A1 1/2013 Weitzel
2014/0156167 A1 * 6/2014 Lukaczyk ..... F02D 19/12 701/102
2014/0262425 A1 9/2014 Hopkinson et al.
2015/0318075 A1 11/2015 Heffner et al.
2018/0060267 A1 * 3/2018 Sutton ..... H04L 12/40032

FOREIGN PATENT DOCUMENTS

| | | |
|---|---|---|
| GB | 2432963 | 6/2007 |
| JP | 2000090748 | 3/2000 |
| JP | 2004311120 | 11/2004 |
| JP | 2006173044 | 6/2006 |
| WO | WO2006105166 | 5/2006 |
| WO | WO2011020967 | 2/2011 |

OTHER PUBLICATIONS

"Draka" 12 pages, Draka Comtez, Cable Solutions, Data Cables, Sep. 27, 2006.
"10 Gigabit Ethernet Solutions" 8 pages, R&M Convincing Cabling Solutions.
Wetzikon, "R&M: THe Rising Stars in Copper Cabling" 2 pages. Sep. 1, 2005.
"R&M Star Real 10" 2 pages, Mar. 2005.
"Connections 29" 36 pages, Sep. 2005.
Pfeiler et al., U.S. Pat. No. 7,335,837, issued Feb. 26, 2008.
Disclosure Statement Under 37 C.F.R. § 1.56, dated Jun. 22, 2017.
Notice of Allowance for U.S. Appl. No. 15/455,182, dated Jun. 28, 2017.
Notice of Allowance for U.S. Appl. No. 15/435,685, dated Aug. 10, 2017.
Non-Final Office Action for U.S. Appl. No. 15/227,390, dated Aug. 30, 2017.
Non-Final Office Action for U.S. Appl. No. 15/845,775, dated Jun. 26, 2017.
Notice of Allowance for U.S. Appl. No. 15/227,365, dated Nov. 14, 2017.
Office Action for U.S. Appl. No. 15/277,390, dated Jan. 17, 2018.
Office Action for U.S. Appl. No. 15/345,775, dated Dec. 21, 2017.
Final Office Action for U.S. Appl. No. 15/435,685, dated Feb. 6, 2018.
Notice of Allowance for U.S. Appl. No. 15/435,685, dated May 9, 2018.
Non-Final Office Action for U.S. Appl. No. 15/624,832, dated Jun. 19, 2018.

* cited by examiner

COMMUNICATIONS CABLES INCORPORATING SEPARATOR STRUCTURES

TECHNICAL FIELD

Embodiments of the disclosure relate generally to communications cables and, more particularly, to communications cables that incorporate separator structures that are positioned between twisted pairs and that are further wrapped around an outer periphery of the twisted pairs.

BACKGROUND

A wide variety of different types of communications cables incorporate twisted pairs. In each pair, two conductors are twisted together in a helical fashion to form a balanced transmission line. Twisted pair cables may include shielded or unshielded twisted pairs ("UTP"), and twisted pair cables may be utilized in a wide variety of applications, such as Ethernet networks and telephone systems. When twisted pairs are placed in close proximity to one another, electrical energy may be transferred from one pair to another pair. Such energy transfer between pairs is undesirable and is referred to as crosstalk. Crosstalk may occur between twisted pairs in the same cable, or between twisted pairs of adjacent cables. Crosstalk causes interference to the information being transmitted through the twisted pairs and can reduce the data transmission rate and can cause an increase in bit rate error. There is an opportunity for communications cables that reduce crosstalk and the electrical performance degradation resulting from crosstalk.

Additionally, in UTP cables, twisted pairs in adjacent cables or cables in relatively close proximity to one another may be more susceptible to alien crosstalk. In order to mitigate the effects of alien crosstalk, it may be desirable to increase the separation distance between the cables. Conventionally, the cable separation distances have been increased by utilizing a thicker cable jacket; however, thicker jackets increase the overall material costs and weight of the cable. Certain conventional cables have been formed in which ribs are formed on an internal surface of the jacket in order to increase the separation distance between adjacent cables. However, it may be possible for twisted pairs to shift or migrate into the gaps or spaces between adjacent ribs, thereby subjecting the pairs to increased alien crosstalk risks. Accordingly, there is an opportunity for improved cable designs that incorporate internal spline or separator structures that further assist in reducing alien crosstalk.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
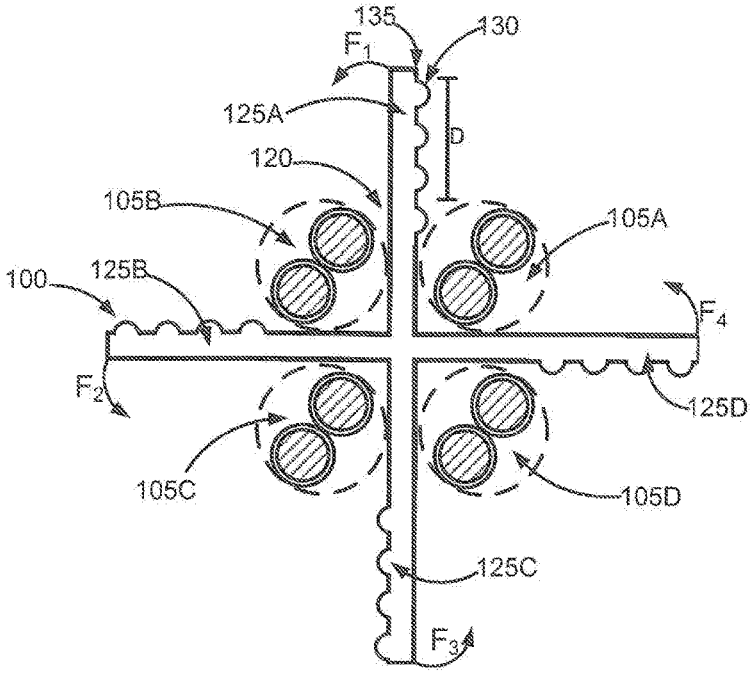
FIG. 1A illustrates a cross-sectional view of an example separator structure that may be positioned between a plurality of twisted pairs and further wrapped around an outer periphery of the twisted pairs, according to an illustrative embodiment of the disclosure.

Various embodiments of the present disclosure are directed to separator structures that may be incorporated into communications cables, and to cables incorporating the separator structures. In certain embodiments, a separator structure, separator, or filler may be incorporated into a cable or a cable component that includes a plurality of twisted pairs of individually insulated conductors. The separator may be positioned between two or more of the twisted pairs, and the separator may assist in orienting the twisted pairs and/or maintaining the positions of the twisted pairs. A portion of the separator that is positioned between two or more of the twisted pairs, also referred to as a central portion, may have a wide variety of suitable cross-sectional shapes and/or dimensions. For example, the separator may have an approximately flat, cross-shaped, or T-shaped cross-section. A jacket or sheath may also be formed around the twisted pairs and the separator.

In certain embodiments, the separator may include one or more prongs or other components that respectively extend between adjacent sets of twisted pairs. For example, one or more prongs may extend from a center point of the separator. In one example embodiment, a cross-shaped separator may include four prongs that respectively extend from a central point. In another example embodiment, a flat separator may be characterized as including two prongs that extend from a central point. In yet another embodiment, a T-shaped separator may be characterized as including two prongs or portions that extend from a center point. A separator may include any number of components that extend between various sets of twisted pairs.

According to an aspect of the disclosure, the separator may include one or more portions that extend beyond and that are wrapped around an outer periphery defined by the plurality of twisted pairs. For example, one or more prongs or other portions of the separator may extend beyond the twisted pairs. In certain embodiments, the extending portions may be characterized as extending from a central portion of the separator (e.g., a cross-shaped central portion, etc.). The extending portion(s) of the separator may be curled, wrapped, or folded around the outer periphery in order to form a partial or complete outer wrap or external layer around the twisted pairs. Additionally, the wrapped extending portion(s) may be formed with a thickness that provides a desired separation between the twisted pairs and a jacket or sheath formed around the twisted pairs and the separator. In this regard, when the cable is positioned adjacent to or in proximity to one or more other cables, the separation distance may reduce or mitigate the risk of alien cross-talk.

Various portions of a separator may be formed with a wide variety of suitable constructions. In certain embodiments, one or more extending portions (and as desired a central portion) may be formed with a variable thickness. For example, one or more ribs, protrusions, projections, knobs, spines, or other extensions may be formed on, protrude from, or extend from a base portion of an extending portion. For purposes of this disclosure, the term "rib" may refer to a wide variety of variable thickness configurations including, but not limited to, thickness variations formed by protrusions, projections, knobs, spines, and/or other extensions extending from a base portion, as well as thickness variations formed by grooves, channels, indentions, holes, orifices, and/or openings formed into a base portion such that ribs exist between them. The presence of the ribs may result in certain sections or areas of the extending portion having a greater overall thickness than other sections, while reducing an overall amount of material required to form the separator.

As desired in various embodiments, ribs may be formed with a wide variety of suitable configurations and/or dimensions. For example, in certain embodiments, ribs may be formed on a surface of an extending portion that faces a jacket or sheath when the extending portion is wrapped around an outer periphery of the twisted pairs. In other embodiments, ribs may be formed on a surface in order to face the twisted pairs. In yet other embodiments, ribs may be formed on both surfaces or sides of an extending portion. Additionally, in certain embodiments, ribs may be formed only on a portion of a prong or separator section that extends beyond the twisted pairs. In other embodiments, ribs may also be formed within a central portion of a separator, such as on sections of prongs positioned between the twisted pairs.

Ribs may also extend in a wide variety of directions and/or with a wide variety of configurations along a separator surface. In certain embodiments, ribs may extend along a surface in a longitudinal direction that is approximately parallel to the twisted pairs longitudinal direction. In other embodiments, ribs may be formed at an angle relative to the longitudinal direction, for example, diagonally across a separator surface. Additionally, in certain embodiments, relatively continuous ribs may be formed. In other embodiments, discontinuous ribs may be formed that include a plurality of discrete sections separated by gaps or spaces. For example, a longitudinally extending rib may include a plurality of spaced sections or portions.

A rib may also be formed with a wide variety of suitable dimensions. For example, ribs may be formed with any suitable cross-sectional shape including, but not limited to, an approximately convex, arcuate, semi-circular, rectangular, triangular, or trapezoidal cross-sectional shape. A rib may also be formed with any suitable width and/or thickness. As desired, a thickness of a rib may be selected in order to provide a desired separation distance between the twisted pairs and an outer jacket or sheath. Additionally, any desirable spacing may be utilized between adjacent ribs. In certain embodiments, a plurality of ribs may be formed with approximately equivalent dimensions. In other embodiments, at least two ribs may be formed with different dimensions, such as different cross-sectional shapes.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Example Separator and Cable Structures

Figure 4A:
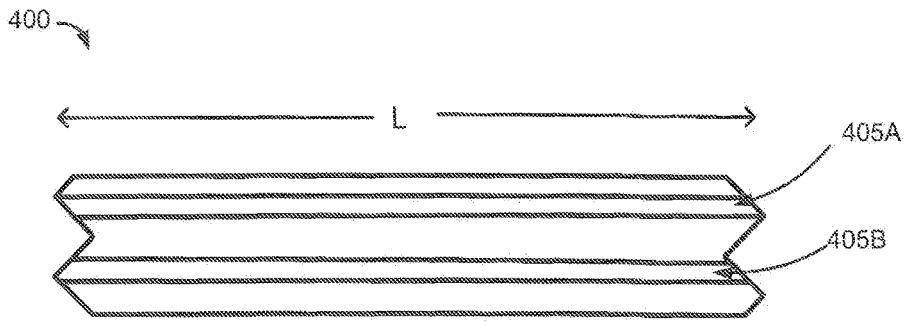
FIGS. 4A-C are top level views of example rib variations that may be utilized in association with separator structures, according to illustrative embodiments of the disclosure.
Figure 4B:
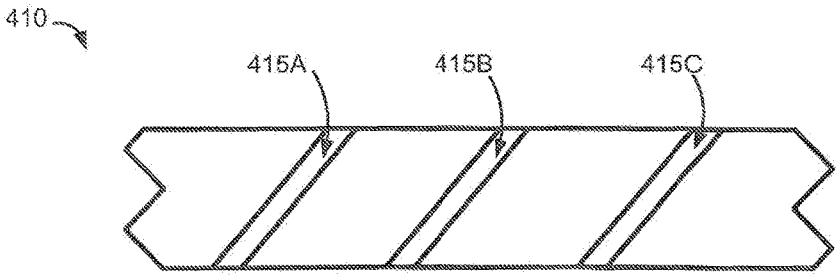
Figure 4C:
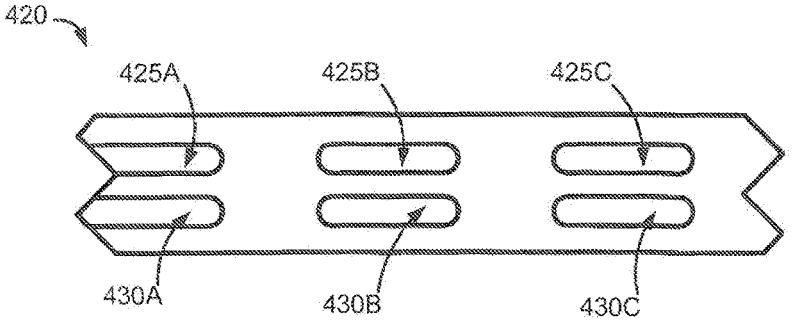
Figure 5A:
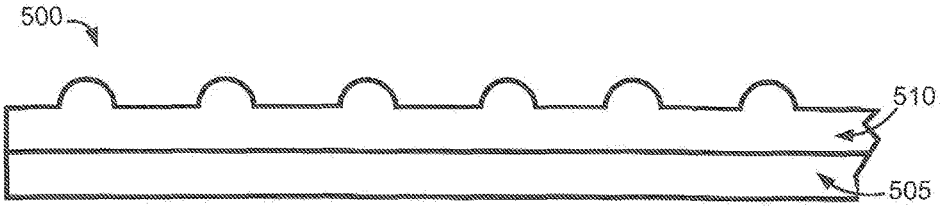
FIGS. 5A-E are cross-sectional views of example layer constructions that may be utilized in association with separator structures, according to illustrative embodiments of the disclosure.
Figure 6A:
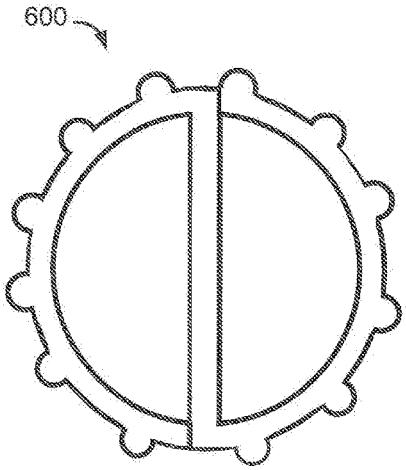
FIGS. 6A-C are cross-sectional views of other example separator structures that may be incorporated into cables, according to illustrative embodiments of the disclosure.
Figure 6B:
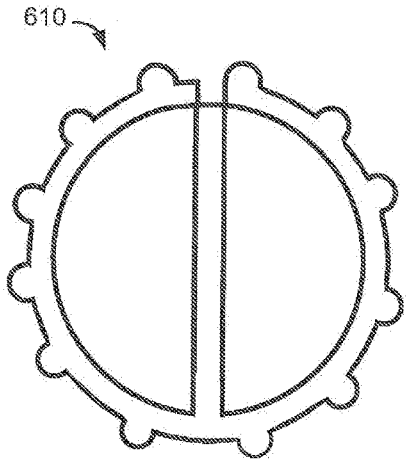
Figure 6C:
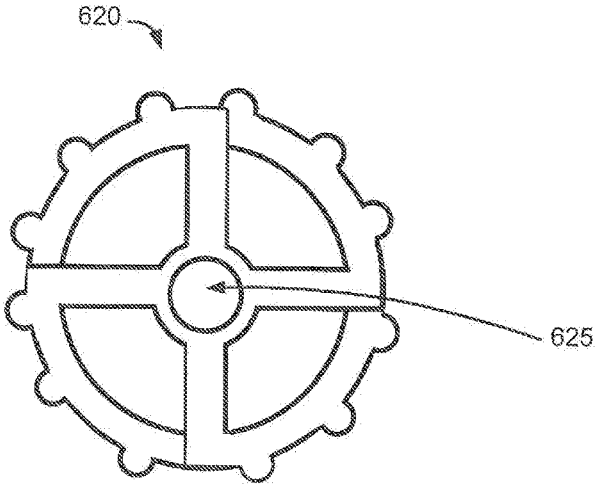
Figure 7A:
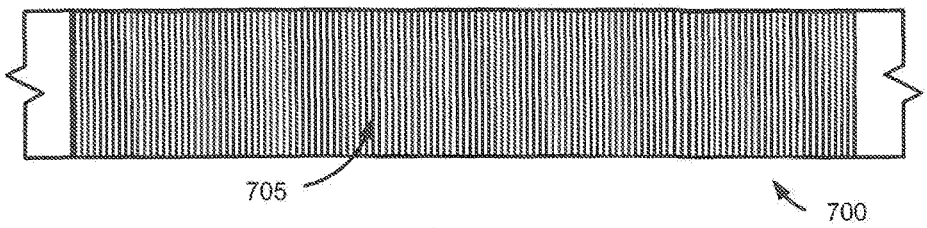
FIGS. 7A-7G are top level views of various configurations of shielding material that may be incorporated into separator structures as desired in various embodiments of the disclosure.
Figure 7B:
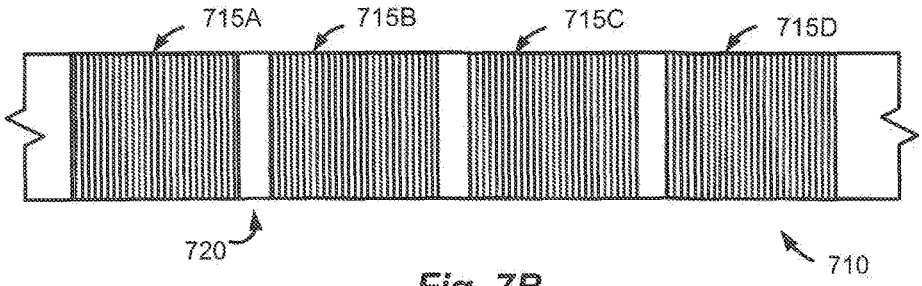
Figure 7C:
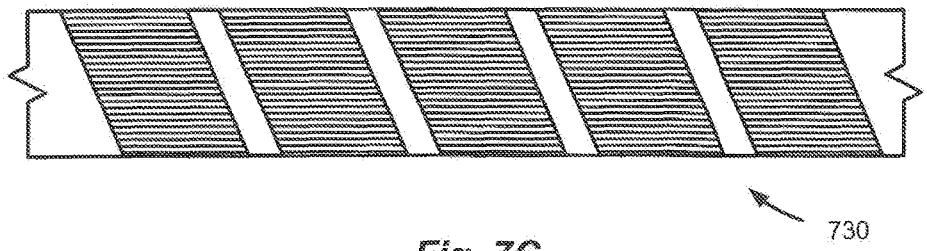

FIGS. 1A-2E illustrate a few example separator structures or separators and cables incorporating separators. In particular, FIG. 1A illustrates a first example separator, and FIG. 1B illustrates a cable incorporating the separator of FIG. 1A. FIGS. 2A-2E illustrate other example separators and/or variations of the separators illustrated in FIGS. 1A and 1B. FIGS. 3A-E illustrate example cross-sections of ribs and/or thickness variations that may be incorporated into a separator, such as any of the separators of FIGS. 1A-2E. FIGS. 4A-C illustrate top level views of example rib configurations that may be formed on a surface of a separator. FIGS. 5A-5E illustrate example layer configurations and/or material constructions that may be utilized in association with a separator. FIGS. 6A-C illustrate example cross-sections that may be utilized to form a central portion of a separator. Finally, FIGS. 7A-C illustrate example configurations of shielding material that may be incorporated into a separator. It will be appreciated that any of the separators illustrated in FIGS. 1A-2E, as well as other suitable separator structures may be modified to include any suitable rib configurations, central portions, and/or dimensions. A wide variety of other types of separator structures may also be utilized in accordance with various embodiments, and those described herein are provided by way of illustrative example only.

Figure 1B:
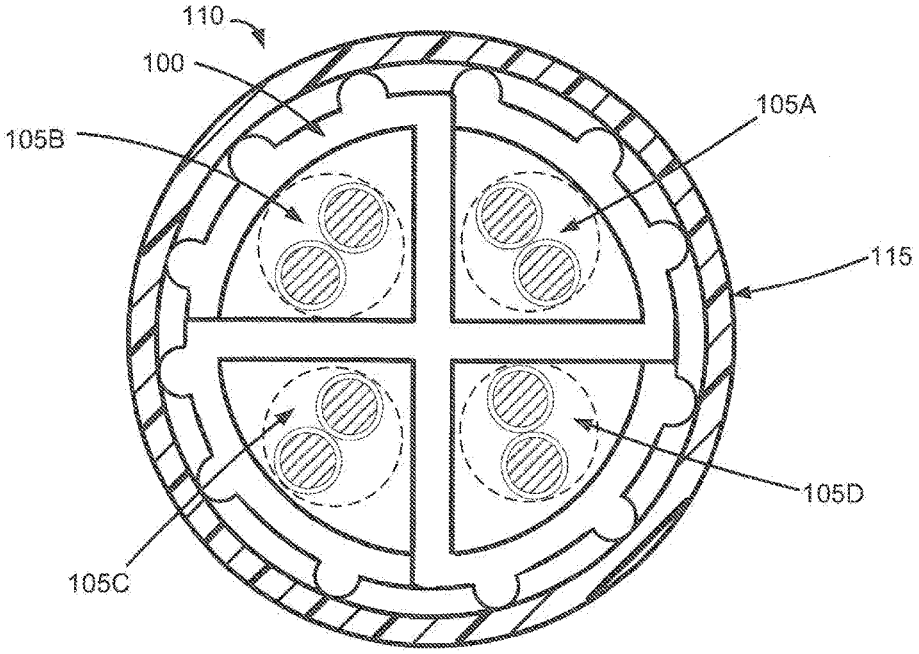
FIG. 1B illustrates a cross-sectional view of an example cable incorporating the separator structure of FIG. 1A, according to an illustrative embodiment of the disclosure.

Turning first to FIG. 1A, a cross-sectional view of an example separator 100 that may be positioned between a plurality of twisted pairs 105A-D is illustrated. As shown, the separator 100 may include a plurality of portions that extend beyond an outer periphery of the twisted pairs 105A-D. These extending portions may be wrapped or curled around the outer periphery of the twisted pairs 105A-D in order to form an outer wrap as illustrated in FIG. 1B. Further, as illustrated in FIG. 1B, the separator 100 and twisted pairs 105A-D may be incorporated into a cable 110. For example, an outer jacket 115 or sheath may be formed around the separator and twisted pairs 105A-D once the extending portions have been wrapped around the outer periphery.

As shown in FIGS. 1A and 1B, four twisted pairs 105A-D may be positioned in proximity to the separator 100 and/or incorporated into a cable 110 with the separator 100. Although four twisted pairs 105A, 105B, 105C, 105D are illustrated, any other suitable number of pairs may be utilized. As desired, the twisted pairs 105A-D may be twisted or bundled together and/or suitable bindings may be wrapped around the twisted pairs 105A-D. In other embodiments, multiple grouping of twisted pairs may be incorporated into a cable, and any of the groupings may include a respective separator. Additionally, as desired, the multiple groupings may be twisted, bundled, or bound together.

Each twisted pair (referred to generally as twisted pair 105) may include two electrical conductors, each covered with suitable insulation. Each twisted pair 105 can carry data or some other form of information, for example in a range of about one to ten Giga bits per second ("Gbps") or another appropriate frequency, whether faster or slower. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. In certain embodiments, the differences between twist rates of twisted pairs 105 that are circumferentially adjacent one another (for example the twisted pair 105A and the twisted pair 105B) may be greater than the differences between twist rates of twisted pairs 105 that are diagonal from one another (for example the twisted pair 105A and the twisted pair 105C). As a result of having similar twist rates, the twisted pairs that are diagonally disposed can be more susceptible to crosstalk issues than the twisted pairs 105 that are circumferentially adjacent; however, the distance between the diagonally disposed pairs may limit the crosstalk.

Additionally, in certain embodiments, each of the twisted pairs 105A-D may be twisted in the same direction (e.g., clockwise, counter clockwise). In other embodiments, at least two of the twisted pairs 105A-D may be twisted in opposite directions. Further, as desired in various embodiments, one or more of the twisted pairs 105A-D may be twisted in the same direction as an overall bunch lay of the combined twisted pairs. For example, the conductors of each of the twisted pairs 105A-D may be twisted together in a given direction. The plurality of twisted pairs 105A-D may then be twisted together in the same direction as each of the individual pair's conductors. In other embodiments, at least one of the twisted pairs 105A-D may have a pair twist direction that is opposite that of the overall bunch lay. For example, all of the twisted pairs 105A-D may have pair twist directions that are opposite that of the overall bunch lay.

The electrical conductors of a twisted pair 105 may be formed from any suitable electrically conductive material, such as copper, aluminum, silver, annealed copper, copper clad aluminum, gold, a conductive alloy, etc. Additionally, the electrical conductors may have any suitable diameter, gauge, cross-sectional shape (e.g., approximately circular, etc.) and/or other dimensions. Further, each of the electrical conductors may be formed as either a solid conductor or as a conductor that includes a plurality of conductive strands that are twisted together.

The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair 105 may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

As the conductors of a twisted pair 105 are twisted together along their longitudinal lengths, the twisted pair 105 may occupy a longitudinally extending volume having an approximately circular cross-sectional shape as illustrated in FIGS. 1A and 1B. In other words, at any given cross-sectional point, the adjacent conductors will not occupy a space having a circular cross-section. However, the twisting may result in the conductors occupying different positions at different cross-sectional points such that the twisted pair 105 occupies a space having an approximately circular cross-section. An outer periphery of the twisted pair 105 may represent the outer limit of the cross-sectional volume taken up by the twisted pair along its longitudinal length. Similarly, the outer periphery of a combined plurality of twisted pairs 105A-D may represent the outer limit of the cross-sectional volume taken up by the plurality of twisted pairs 105A-D along their longitudinal lengths.

The jacket 115 may enclose the internal components of the cable 110, seal the cable 110 from the environment, and provide strength and structural support. The jacket 115 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 115 may be formed as a single layer or, alternatively, as multiple layers. In certain embodiments, the jacket 115 may be formed from one or more layers of foamed material. As desired, the jacket 115 can include flame retardant and/or smoke suppressant materials. Additionally, the jacket 115 may include a wide variety of suitable shapes and/or dimensions. For example, the jacket 115 may be formed to result in a round cable or a cable having an approximately circular cross-section; however, the jacket 115 and internal components may be formed to result in other desired shapes, such as an elliptical, oval, or rectangular shape. The jacket 115 may also have a wide variety of dimensions, such as any suitable or desirable outer diameter and/or any suitable or desirable wall thickness. In various embodiments, the jacket 115 can be characterized as an outer jacket, an outer sheath, a casing, a circumferential cover, or a shell.

An opening enclosed by the jacket 115 may be referred to as a cable core, and the twisted pairs 105A-D and the separator 100 may be disposed within the cable core. Although a single cable core is illustrated in FIG. 1B, a cable may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the twisted pairs 105A-D. Other elements can be added to the cable core as desired, for example one or more optical fibers, additional electrical conductors, additional twisted pairs, water absorbing materials, and/or strength members, depending upon application goals.

The separator 100 or filler may be positioned between two or more of the twisted pairs 105A-D and/or disposed within a cable core. In certain embodiments, the separator 100 may be configured to orient and or position one or more of the twisted pairs 105A-D. The orientation of the twisted pairs 105A-D relative to one another may provide beneficial signal performance. As desired in various embodiments, the separator 100 may be formed in accordance with a wide variety of suitable dimensions, shapes, or designs. For example, the separator 100 may have any suitable cross-sectional shape. The separator 100 illustrated in FIGS. 1A and 1B has an approximately cross-shaped cross-section.

Additionally, the separator 100 may include a central portion 120 positioned between the twisted pairs 105A-D and one or more extending portions 125A-D that extend from the central portion 120 and that may be wrapped or curled around an outer periphery of the twisted pairs 105A-D. In certain embodiments, an extending portion may be a section of a central portion component. For example, with the cross-shaped separator 100 of FIGS. 1A and 1B, the central portion 120 may include a plurality of prongs extending from a central point with each prong extending between a respective set of adjacent twisted pairs. One or more of the prongs may extend beyond the outer periphery of the twisted pairs 105AD, and the portion of a prong extending beyond the outer periphery may be referred to as an extending portion (generally referred to as extending portion 125). In other embodiments, an extending portion 125 may be a component of the separator 100 that is distinct from the central portion 120. For example, an extending portion 125 may be a component that is attached or affixed to a central portion 120. Indeed, a wide variety of suitable separator constructions may be formed as desired. Regardless of the construction of the separator 100, for purposes of this disclosure, a central portion 120 is a portion of a separator 100 positioned between two or more of a plurality of twisted pairs 105A-D while an extending portion 125 is a portion of the separator 100 that extends beyond an outer periphery of the twisted pairs 105A-D.

Although the separator 100 illustrated in FIGS. 1A and 1B has an approximately cross-shaped cross section, other suitable cross-sectional shapes may be utilized. As other examples, a flat separator, a T-shaped separator, a Y-shaped separator, a J-shaped separator, an L-shaped separator, a separator having any number of spokes extending from a central point, a separator having walls or channels with varying thicknesses, a separator having I-shaped members extending from a central point or center member, a separator including any number of suitable fins, and/or a wide variety of other shapes may be utilized. Additionally, in certain embodiments, the separator 100 may include one or more prongs or other components that respectively extend between adjacent sets of twisted pairs. For example, one or more prongs may extend from a center point of the separator 100. A cross-shaped separator, such as the separator 100 illustrated in FIGS. 1A and 1B, may include four prongs that respectively extend from a central point. In another example embodiment, a flat separator may be characterized as including two prongs that extend from a central point. In yet another embodiment, a T-shaped separator may be characterized as including two prongs or portions that extend from a center point. A separator may include any number of components that extend between various sets of twisted pairs. A few other example cross-sectional shapes that are described in greater detail below with reference to FIGS. 6A-6C.

In certain embodiments, the separator 100 may include one or more longitudinally extending channels or longitudinal channels that facilitate convective heat transfer within the cable 100. FIG. 6C, discussed in greater detail below, illustrates an example separator that includes a longitudinally extending channel. As desired in various embodiments, a single longitudinal channel or a plurality of separator longitudinally extending channels may be incorporated into the separator 100. In certain embodiments, the separator may additionally include one or more second channels that extend from a longitudinal channel through the separator 100. For example, one or more second channels may extend from the cavity defined by a longitudinal channel through a body of the separator 100 to an outer surface of the separator 100. As another example, one or more second channels may extend through the separator body in order to connect two or more longitudinal channels. A second channel may contact a longitudinal channel at any desired angle. These second channels may further facilitate convective heat transfer via the separator 100. For example, one or more second channels may facilitate transfer of heat from other areas of the cable core (e.g., areas in which one or more twisted pairs 105 are positioned) to the longitudinal channel, and the longitudinal channel 125 may then assist in normalizing the temperature of the cable 100 along its longitudinal length.

In certain embodiments, a separator 100 may be formed from a single segment or portion. In other words, the separator 100 may be formed as a relatively continuous separator along a longitudinal length of the cable 110. In other embodiments, a separator 100 may be formed from a plurality of discrete or severed segments or portions. For example, discrete segments or portions may be positioned adjacent to one another along a longitudinal length of the separator 100. In certain embodiments, gaps or spaces may be present between various segments or portions of the separator 100. In other embodiments, at least a portion of the segments may be arranged in an overlapping configuration.

The separator 100 may have a body formed from a wide variety of suitable materials as desired in various embodiments. For example, the separator 100 and/or various separator segments can include paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, choloro-sulphonated polyethylene, flame retardant PVC, low temperature oil resistant PVC, flame retardant polyurethane, flexible PVC, one or more dielectric shielding materials (e.g., barium ferrite, etc.) or any other suitable material or combination of materials. In certain embodiments, the separator 100 may have a relatively flexible body. As desired, the separator 100 may be filled, unfilled, foamed, un-foamed, homogeneous, or inhomogeneous and may or may not include additives (e.g., flame retardant and/or smoke suppressant materials).

As desired, a wide variety of suitable techniques and/or processes may be utilized to form the separator 100 or various segments or components of the separator 100. For example, a material or combination of materials may be extruded, pultruded, or otherwise formed into a desired cross-sectional shape. As desired in various embodiments, the separator 100 or one or more components of the separator may have a substantially uniform composition, may be made of a wide range of materials, and/or may be fabricated in a single manufacturing pass. In other embodiments, the a plurality of manufacturing passes and/or steps may be utilizes to form the separator 100. As desired, the separator 100 or one or more separator components may be foamed, may be a composite, and/or may include one or more strength members, fibers, threads, or yarns. In certain embodiments, electrically conductive material or other shielding material may be incorporated into the separator 100. For example, shielding material may be applied to a base material, inserted into a base material, and/or embedded in the base material. In other embodiments, dielectric material may be formed around shielding material.

For a segmented separator formed from a plurality of discrete or severed segments, the various portions or segments of the separator 100 may include a wide variety of different lengths and/or sizes. For example, a portion of the separator 100 may be approximately six inches, one foot, two feet, or any other suitable length. As another example, a portion of the separator 100 may be approximately half a meter, one meter, two meters, or three meters. In certain embodiments, portions of the separator 100 may be approximately three meters or less. In certain embodiments, portions having a common length may be incorporated into the cable 100. In other embodiments, portions of the separator 100 may have varying lengths. These varying lengths may follow an established pattern or, alternatively, may be incorporated into the cable 110 at random. Additionally, in certain embodiments, each segment or portion of the separator 100 may be formed from similar materials. In other embodiments, a separator 100 may make use of alternating materials in adjacent portions (whether or not a gap is formed between adjacent portions). For example, a first portion or segment of the separator 100 may be formed from a first set of one or more materials, and a second portion or segment of the separator 100 may be formed from a second set of one or more materials. As one example, a relatively flexible material may be utilized in every other portion of a separator 100. As another example, relatively expensive flame retardant material may be selectively incorporated into desired portions of a separator 100. In this regard, material costs may be reduced while still providing adequate flame retardant qualities.

According to an aspect of the disclosure, the separator 100 may include one or more portions 125A-D that extend beyond and that are wrapped around an outer periphery defined by the plurality of twisted pairs 105A-D. The extending portions 125A-D may form at least a portion of an outer wrap or shield around the twisted pairs 105A-D. With reference to FIGS. 1A and 1B, each of the prongs incorporated into the cross-shaped separator 100 may include a respective extending portion 125A-D. In other embodiments, only a portion of the prongs incorporated into a separator 100 may include a respective extending portion. A few example separators in which only a portion of the prongs include a respective extending portion are described in greater detail below with reference to FIGS. 2A and 2B. As desired in various embodiments, a separator may have any suitable number of prongs that include extending portions. In other embodiments, one or more extending portions may extend from portions of a separator other than prongs. Indeed, one or more extending portions may extend from any suitable part of a central portion 120 of a separator.

An extending portion (generally referred to as extending portion 125) may have a wide variety of suitable dimensions. For example, an extending portion may extend beyond the outer periphery by any suitable distance "D". Examples of suitable values for "D" include, but are not limited to, distances of approximately 3.0 mm, 5.0 mm, 7.0 mm, 10.0 mm, 12.0 mm, 15.0 mm, 17.0 mm, 20.0 mm, distances included in a range between any two of the above values, or distances included in a range bounded on either a minimum or maximum end by one of the above values. In certain embodiments, the distance "D" may correlate to a desired degree of wrapping around the outer periphery. In other words, when the extending portion 125 is wrapped or curled around the outer periphery of the twisted pairs 105A-D to form at least a portion of an outer shield, the distance "D" may correlate to a desired wrap coverage. For example, the distance "D" may correspond to a length that is approximately one quarter (e.g., approximately 90°), approximately one half (e.g., approximately 180°), or approximately equivalent to (e.g., approximately 360°) the distance around the outer periphery of the twisted pairs 105A-D.

Additionally, in certain embodiments, an extending portion 125 may be relatively continuous along a longitudinal length of the separator 100. In other words, a longitudinally extending edge at the end of an extending portion 125 may be continuous along the longitudinal length. In other embodiments, a dimension (e.g., a cross-sectional length, etc.) of a prong or other portion of a separator 100 may be varied along its longitudinal length such that only certain portions extend beyond the outer periphery and/or such that various portions extend different distances beyond the outer periphery. Indeed, a wide variety of different configurations of extending portions may be utilized as desired. Additionally, as desired, a dimension of a prong or other portion may be varied in accordance with a desired patter or, alternatively, in a random or pseudo-random fashion. In the event that a dimension is varied such that an extending portion 125 extends at various sections along a longitudinal length of the separator 100, each section may have any desired longitudinal length. Additionally, in certain embodiments, each section may have approximately the same longitudinal length. In other embodiments, at least two sections may have different longitudinal lengths.

In certain embodiments, an extending portion 125 may have a similar construction as a central portion of a separator 100. For example, a separator 100 may be formed with a uniform construction. In other embodiments, an extending portion 125 may have a different construction than a central portion 120. For example, an extending portion 125 may have a different thickness than a central portion 120. In this regard, an outer wrap formed around the twisted pairs 105A-D may have a different thickness than a central portion 120 positioned between the pairs 105A-D. As another example, an extending portion 125 may have a varying thickness while a central portion 120 has a relatively uniform thickness. As yet another example, an extending portion 125 may be formed from different material(s) than a central portion 120. As yet another example, an extending portion 125 may be formed with a different number of layers and/or a different arrangement of layers relative to a central portion 120. Further, as desired, various sections of an extending portion 125 may have different constructions. Indeed, a separator 100 may be formed with a wide variety of suitable configurations. A few example layer configurations and/or cross-sectional constructions that may be utilized for an extending portion 125 and/or other portions of a separator 100 are described in greater detail below with reference to FIGS. 5A-5C.

Once the separator 100 has been positioned between a plurality of twisted pairs 105A-D as illustrated in FIG. 1A, the extending portion(s) 125A-D of the separator 100 may be curled, wrapped, folded, or otherwise positioned around the outer periphery in order to form a partial or complete outer wrap or external layer around the twisted pairs. In certain embodiments, each of the extending portions 125A-D may be wrapped or curled in a similar direction, such as a counter-clockwise or clockwise direction. For example, a first extending portion 125A may be curled or wrapped in direction $F_1$, a second extending portion 125B may be curled or wrapped in direction F2, a third extending portion 125C may be curled or wrapped in direction F3, and a fourth extending portion 125D may be curled or wrapped in direction F4. In this regard, the separator 100 may form an outer wrap or shield layer at least partially around the twisted pairs 105A-D. As depicted in FIG. 1B, the outer wrap layer may encase or completely surround the twisted pairs 105A-D. In other embodiments, an outer wrap layer may partially surround the twisted pairs 105A-D (i.e., occupy only a portion of an outer periphery of the twisted pairs 105A-D). Additionally, in other embodiments, at least two extending portions may be curled or wrapped in opposite directions. In this regard, double shield layers may be formed as desired.

A wide variety of suitable methods and/or techniques may be utilized to wrap or curl the extending portion(s) 125A-D around an outer periphery of the twisted pairs 105A-D. Examples of suitable equipment that may be utilized to wrap the extending portions include, but are not limited to, suitable dies, funnels, rollers, air knives, etc. In certain embodiments, an extending portion 125 may be wrapped around the outer periphery of the twisted pairs 105A-D without substantially spiraling the outer portion around or about the twisted pair 105A-D. Alternatively, an extending portion may be wrapped so as to spiral around the twisted pairs 105A-D.

In certain embodiments, once wrapped or curled around the twisted pairs 105A-D, the extending portions 125A-D may be held in place by a binder or other sheath, such as the jacket 115. In other embodiments, once wrapped or curled around the twisted pairs 105A-D, certain extending portions may be bonded or attached together. For example, extending portions that are adjacent or in close proximity with one another following wrapping may be optionally bonded together. A wide variety of suitable methods and/or techniques may be utilized to bond or join extending portions 125A-D together. In certain embodiments, extending portions 125A-D may be adhered together with one or more suitable adhesives including, but not limited, to glue, epoxy, pressure sensitive adhesive, contact adhesive, thermoset adhesive, radiation curable adhesive, etc. In other embodiments, extending portions 125A-D may be ultrasonically welded or bonded together. In yet other embodiments, extending portions 125A-D may be attached together with any number of suitable mechanical fasteners, such as staples, pins, rivets, etc. In certain embodiments, one or more extending portions 125A-D may be constructed to include an adhesive (e.g., a longitudinal line of adhesive, etc.) that is covered by a suitable film layer at or near its longitudinally extending edge. Prior to and/or during a wrapping or curling operation of an extending portion, the film layer may be removed such that the extending portion may be bonded to another extending portion. As an alternative to bonding two extending portions to one another, an extending portion may be bonded to one or more of the twisted pairs 105A-D. In yet other embodiments, such as an embodiment in which an extending portion 125 is wrapped around the entire outer periphery of the twisted pairs 105A-D, the extending portion 125 may be bonded to itself.

Additionally, in certain embodiments, an extending portion 125 may be bonded to another extending portion (or other component) continuously along the length of the separator 100. In other embodiments, an extending portion 125 may be bonded to another component at a plurality of discrete points or locations along the longitudinally length of the separator 100. As desired, spaced points or sections for bonding may be formed in accordance with any desired pattern or, alternatively, in a random or pseudo random fashion. Additionally, bonding sections may have any suitable longitudinal length and any desired separation distance may be present between adjacent attachment sections.

Additionally, according to an aspect of the disclosure, the wrapped extending portion(s) 125A-D may be formed with a thickness that provides a desired separation between the twisted pairs 105A-D and a jacket 115 or sheath formed around the twisted pairs 105A-D and the separator 100. In this regard, when the cable 110 is positioned adjacent to or in proximity to one or more other cables, the separation distance may reduce or mitigate the risk of alien cross-talk.

In certain embodiments, one or more extending portions 125A-D (and as desired a central portion 120) may be formed with a variable thickness. For example, as shown in FIGS. 1A and 1B, one or more ribs, protrusions, projections, knobs, spines, or other extensions 130 may be formed on, protrude from, or extend from a base portion 135 of an extending portion 125. For purposes of this disclosure, the term "rib" 130 may refer to a wide variety of variable thickness configurations including, but not limited to, thickness variations formed by protrusions, projections, knobs, spines, and/or other extensions extending from a base portion 130, as well as thickness variations formed by grooves, channels, indentions, holes, orifices, and/or openings formed into a base portion 130 such that ribs exist between them. The presence of the ribs 130 may result in certain sections or areas of the extending portion 125 having a greater overall thickness than other sections, while reducing an overall amount of material required to form the separator 100.

As desired in various embodiments, ribs 130 may be formed with a wide variety of suitable configurations and/or dimensions. For example, in certain embodiments and as shown in FIGS. 1A and 1B, ribs 130 may be formed on a surface of an extending portion 125 that faces a jacket 115 or sheath when the extending portion 125 is wrapped around an outer periphery of the twisted pairs 105A-D. In other embodiments, as explained in greater detail below with reference to FIG. 2D, ribs 130 may be formed on a surface of an extending portion 125 that faces the twisted pairs 105A-D when the extending portion is wrapped around the outer periphery. In yet other embodiments, as explained in greater detail below with reference to FIG. 2E, ribs 130 may be formed on both surfaces or sides of an extending portion 125. Additionally, in certain embodiments, ribs 130 may be formed only on a portion of a prong or separator section that extends beyond the twisted pairs. In other words, ribs 130 may be formed only on an extending portion 125 of the separator 100. In other embodiments, as explained in greater detail below with reference to FIG. 2C, ribs 130 may also be formed within a central portion 120 of a separator 100, such as on sections of prongs positioned between the twisted pairs 105A-D.

Ribs 130 may also extend in a wide variety of directions and/or with a wide variety of configurations along a separator surface, such as an extended portion surface. In certain embodiments, one or more ribs 130 may extend along a surface in a longitudinal direction that is approximately parallel to the longitudinal direction of the twisted pairs 105A-D. In other embodiments, one or more ribs 130 may be formed at an angle relative to the longitudinal direction, for example, diagonally across a separator surface or perpendicular to the longitudinal direction of the twisted pairs 105A-D. Additionally, in certain embodiments, each of the ribs 130 formed on a separator surface may extend in a similar direction. In other embodiments, at least two ribs may extend in different directions. Further, in certain embodiments, relatively continuous ribs may be formed on a separator surface. For example, a longitudinally extending rib may be relatively continuous along a longitudinal length of the separator 100. In other embodiments, discontinuous ribs may be formed that include a plurality of discrete sections separated by gaps or spaces. For example, a longitudinally extending rib may include a plurality of spaced sections or portions. In the event that discontinuous ribs are formed, each rib section may have any suitable dimensions, such as any suitable length. Additionally, a gap or space between adjacent ribs may have any suitable dimensions. In certain embodiments, rib sections may be formed in accordance with a desired pattern having a repeating step. In other embodiments, rib sections may be formed in a random or pseudo-random manner. A few non-limiting examples of rib configurations that may be formed on a separator surface are described in greater detail below with reference to FIGS. 4A-C.

Ribs 130 may also be formed with a wide variety of suitable dimensions. For example, a rib 130 may be formed with any suitable cross-sectional shape including, but not limited to, an approximately convex, arcuate, semi-circular, rectangular, triangular, or trapezoidal cross-sectional shape. FIGS. 1A and 1B illustrate ribs 130 having arcuate or semi-circular cross-sectional shapes; however, a few other example cross-sectional shapes are described in greater detail below with reference to FIGS. 3A-3E. A rib 130 may also be formed with any suitable width (e.g., a cross-sectional width that the rib will occupy along an outer periphery of the twisted pairs 105A-D), and any desirable spacing may be utilized between adjacent ribs. In certain embodiments, a rib 130 may have a width (e.g., a base width where it extends from a separator, etc.) between approximately 25 μm and approximately 250 μm, such as a width between approximately 50 μm and approximately 75 μm. In various embodiments, a rib may have a width of approximately 15, 20, 25, 30, 40, 50, 60, 75, 100, 125, 150, 175, 200, 225, 250, 275, or 300 μm, a width included in a range between any two of the above values, or a width included in a range bounded on either a minimum or maximum end by one of the above values. A gap or spacing between adjacent ribs may be approximately 15, 20, 25, 30, 40, 50, 60, 75, 100, 125, 150, 175, 200, 225, 250, 275, or 300 μm, a distance included in a range between any two of the above values, or a distance included in a range bounded on either a minimum or maximum end by one of the above values. In certain embodiments, the gap widths may be approximately equivalent to the widths of the ribs. As desired, rib and/or gap widths may be famed in accordance with a desired pattern. In other embodiments, rib and/or gap widths may be formed in a random or pseudo-random manner.

Further, any number of ribs 130 may be formed on a separator surface. In certain embodiments, the number of ribs 130 formed may be based at least in part on the width of the ribs 130 and the spacing between adjacent ribs. As desired, the number of ribs 130, as well as the sizing of the ribs 130 and gaps between adjacent ribs, may be selected so as to facilitate the ribs 130 maintaining a desired separation distance between the twisted pairs 105A-D and the outer jacket 115. Additionally, a total number of ribs 130 formed around an outer periphery of the twisted pairs 105A-D may be the combined number or ribs 130 formed on the one or more extending portions 125A-D wrapped around the outer periphery. In various embodiments, the number of ribs formed around the outer periphery may be approximately 4, 6, 8, 10, 12, 14, 16, 18, 20, a number included in a range between any two of the above values, or a number included in a range bounded on either a minimum or maximum end by one of the above values.

As desired, a rib 130 may also be formed with any desired and/or suitable thickness (e.g., a cross-sectional thickness measured from a base portion of an extending portion 125 or central portion to a distal end or peak of the rib 130). As desired, a thickness of a rib may be selected in order to provide a desired separation distance between the twisted pairs 105A-D and an outer jacket 115 or sheath. In certain embodiments, a rib 130 may have a thickness between approximately 25 μm and approximately 250 μm, such as a thickness between approximately 50 μm and approximately 75 μm. In various embodiments, a rib may have a thickness of approximately 15, 20, 25, 30, 40, 50, 60, 75, 100, 125, 150, 175, 200, 225, 250, 275, or 300 μm, a thickness included in a range between any two of the above values, or a thickness included in a range bounded on either a minimum or maximum end by one of the above values. Additionally, a combination of a rib 130 and a base portion may have any suitable thickness. For example, in various embodiments, a combined rib 130 and base portion may have a thickness between approximately 50 μm and approximately 300 μm. In various embodiments, an overall thickness may be approximately 30, 40, 50, 60, 75, 100, 125, 150, 175, 200, 225, 250, 275, 300, 350, or 400 μm, a thickness included in a range between any two of the above values, or a thickness included in a range bounded on either a minimum or maximum end by one of the above values.

Similarly, if ribs are formed on a central portion 120 of the separator 100, any number of ribs may be formed on the central portion 120 and the ribs may have any suitable dimensions. In certain embodiments, the dimensions and/or spacing of ribs formed on the central portion 120 may be approximately equal to ribs formed on one or more extending portions 125A-D. In other embodiments, ribs formed on the central portion 120 may have different dimensions and/or constructions than those formed on an extending portion 125. Additionally, even within a given extending portion 125 or desired section of a central portion, a plurality of ribs may be formed with approximately equivalent dimensions in certain embodiments. In other embodiments, at least two ribs may be formed with different dimensions, such as different cross-sectional shapes.

In certain embodiments, the separator 100 may be formed without incorporating shielding material. For example, the separator 100 and/or various components may be formed from suitable dielectric materials. In other embodiments, electromagnetic shielding material may be incorporated into the separator 100. A wide variety of different types of materials may be utilized to provide shielding, such as electrically conductive material, semi-conductive material, and/or dielectric shielding material. A few examples of suitable materials are described in greater detail below. Additionally, as desired in various embodiments, shielding material may be incorporated into the separator 100 at a wide variety of locations. In certain embodiments, shielding material may be formed on one or more surfaces of the separator 100. For example, shielding material may be formed on an external surface of the separator 100 and/or on an internal surface of the separator 100 (e.g., within a longitudinal channel. In other embodiments, shielding material may be embedded within the body of the separator 100. For example, particles of shielding material may be blended into or otherwise incorporated into the body of the separator 100. As another example, a layer of shielding material may be positioned between layers of a separator body, such as two dielectric layers. In yet other embodiments, a separator 100 may be extruded, molded, or otherwise formed from a one or more suitable shielding materials. For example, a separator 100 may be formed from one or more conductive, semi-conductive, and/or dielectric shielding materials. In yet other embodiments, a separator 100 may include a plurality of different types of shielding materials. For example, a separator 100 may be extruded from a dielectric shielding material and one or more layers of electrically conductive material may be formed on the separator 100. A wide variety of other suitable separator constructions that incorporate shielding material may also be utilized.

In certain embodiments, the separator 100 may include shielding material that is continuous along the longitudinal length of the separator 100. For example, a relatively continuous layer of shielding material may be formed on a separator surface. As another example, the separator 100 may be formed from one or more shielding materials. In other embodiments, the separator 100 may include discontinuous shielding material. With discontinuous shielding material, shielding material may be spaced throughout the separator 100 or within a layer of the separator 100 (e.g., a layer formed on a surface) and gaps or spaces may be present between adjacent sections of shielding material. In certain embodiments, one or more discontinuous patches of shielding material may be formed. A wide variety of suitable configurations and/or patterns of shielding material may be formed as desired in various embodiments.

Shielding material may be incorporated into a separator 100 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the patches of shielding material can be over-coated with a dielectric layer or electrically insulating film, such as a polyester coating. In other embodiments, shielding material may be embedded into a base layer or dielectric layer.

A wide variety of suitable materials and/or combination of materials may be utilized to form shielding layers and/or patches of shielding material. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc. Additionally, each patch of shielding material may have any desired thickness, such as a thickness of about 0.5 mils (about 13 microns) or greater. In many applications, signal performance benefits from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. Indeed, with a thickness of less than about 1.5 mils, negative insertion loss characteristics may be present on the cable 100.

Regardless of whether a separator 100 is longitudinally continuous or segmented (e.g., the separator includes a plurality of discrete segments), discontinuous patches of shielding material may be formed with a wide variety of patch lengths (e.g., lengths along a longitudinal direction of the cable 100) may be utilized. As desired, the dimensions of the patches can be selected to provide electromagnetic shielding over a specific band of electromagnetic frequencies or above or below a designated frequency threshold. In certain embodiments, each patch may have a length of about one meter to about one hundred meters, although lengths of less than one meter (e.g., lengths of about 1.5 to about 2 inches, etc.) may be utilized. For example, the patches may have a length in a range of about one to ten meters. In various embodiments, the patches can have a length of about 0.5, 0.75, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values.

In the event that a plurality of patches is formed on separator 100 or separator segment, a wide variety of suitable gap distances or isolation gaps may be provided between adjacent patches. For example, the isolation spaces can have a length of about 0.5, 1.0, 1.5, 2.0, 2.5, 3.0, 3.5, or 4 millimeters, a length included in a range between any two of the above values, or a length included in a range bounded on either a minimum or maximum end by one of the above values. As explained in greater detail below with reference to FIG. 7F, in certain embodiments, a plurality of microcuts may be utilized to form a gap between two patches. Additionally, as desired, the patches may be formed as first patches (e.g., first patches on a first side of a dielectric material or body portion, on an outer surface), and second patches may be formed on an opposite side or layer of the separator 100 (e.g., on an opposite side of a dielectric material or body portion, within a longitudinal channel, etc.). For example, second patches may be formed to correspond with the gaps or isolation spaces between the first patches. As desired, the patches may have a wide variety of different shapes and/or orientations. For example, the patches may have a rectangular, trapezoidal, or parallelogram shape. A few example shapes for patches are described in greater detail below with reference to FIGS. 7A-7G.

In certain embodiments, patches may be formed to be approximately perpendicular (e.g., square or rectangular segments and/or patches) to the longitudinal axis of the adjacent one or more pairs 105A-D. In other embodiments, the patches may have a spiral direction that is opposite the twist direction of the enclosed one or more pairs 105A-D. That is, if the twisted pair 105A-D are twisted in a clockwise direction, then the patches may spiral in a counterclockwise direction. If the twisted pairs 105A-D are twisted in a counterclockwise direction, then the patches may spiral in a clockwise direction. Thus, twisted pair lay opposes the direction of the segment and/or patch spiral. The opposite directions may provide an enhanced level of shielding performance. In other embodiments, the patches may have a spiral direction that is the same as the twist direction of the enclosed one or more pairs 105A-D.

As shown, a cable 110 incorporating the separator 100 may be formed as an unshielded cable. In other words, regardless of whether the separator 100 includes shielding material, no separate shield layers are formed either individually around the twisted pairs 105A-D or around any groupings of twisted pairs. In other embodiments, one or more shield layers may be incorporated into the cable 110. For example, an individual shield layer may be provided for each respective twisted pair 105A-D. As another example, one or more shield layers may be provided for various groupings of the twisted pairs 105A-D. As yet another example, an overall shield layer may be formed around the plurality of twisted pairs 105A-D. In the event that one or more shield layers are incorporated into the cable 110, the shield layer(s) may be formed with a wide variety of suitable constructions. For example, a shield layer may be formed as a tape structure with electrically conductive material formed on a base dielectric layer. Additionally, the shield layer(s) may include a wide variety of suitable patch configurations, such as any of the patch configurations discussed herein with respect to the separator.

As desired in various embodiments, a wide variety of other materials may be incorporated into the cable 110 of FIG. 1B. For example, the cable 110 may include any number of conductors, twisted pairs, optical fibers, and/or other transmission media. As another example, one or more respective dielectric films or other suitable components may be positioned between the individual conductors of one or more of the twisted pairs 105A-D. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cable 110 illustrated in FIG. 1B is provided by way of example only. Embodiments of the disclosure contemplate a wide variety of other cables and cable constructions. These other cables may include more or less components than the cable 110 illustrated in FIG. 1B. Additionally, certain components may have different dimensions and/or materials than the components illustrated in FIG. 1B. Additionally, although FIG. 1B illustrates a jacketed cable, the separator 100 may be incorporated into a wide variety of other cable components. For example, the separator 100 may be incorporated into an unjacketed twisted pair component or twisted pair core that is incorporated into a larger cable structure.

Figure 2A:
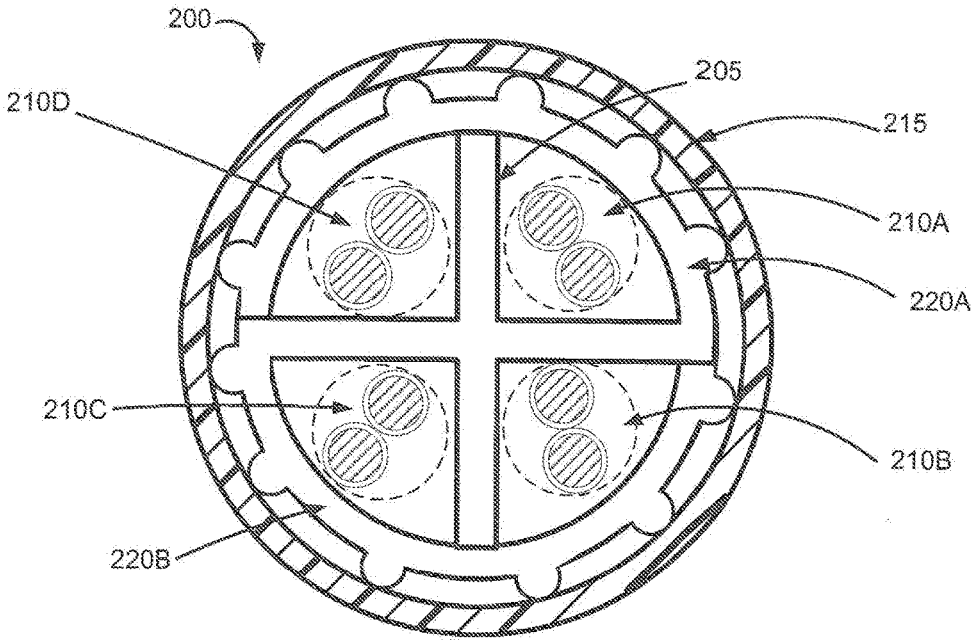
FIGS. 2A-E are cross-sectional views of example cables that include other separator structures that may be positioned between a plurality of twisted pairs and further wrapped around an outer periphery of the twisted pairs, according to illustrative embodiments of the disclosure.

FIGS. 2A-E are cross-sectional views of example cables that include other separator structures that may be positioned between a plurality of twisted pairs and further wrapped around an outer periphery of the twisted pairs, according to illustrative embodiments of the disclosure. Turning first to FIG. 2A, an example cable 200 is illustrated in which a separator 205 may be positioned between a plurality of twisted pairs 210A-D. A jacket 215 may then be formed around the twisted pairs 210A-D and the separator 205. Each of the components of the cable 200 may be similar to those discussed above with reference to FIGS. 1A and 1B.

However, in contrast to the separator 100 illustrated in FIGS. 1A and 1B, the separator 205 of FIG. 2A may include two extending portions 220A, 220B rather than four extending portions 125A-D. In other words, with a separator 205 having an approximately cross-shaped cross-section, only two of the prongs may extend beyond and may be wrapped around an outer periphery of the twisted pairs 210A-D. As shown, each extending portion 220A, 220B may extend at least approximately 180° around the outer periphery. In other embodiments, an extending portion may extend another desired distance around the outer periphery. As desired, an overlap may be formed between an extending portion and an underlying portion of the separator 205 (e.g., an underlying extending portion) when the extending portion is wrapped around the outer periphery. As set forth in greater detail above, any desired amount of overlap may be formed. An overlapping portion may optionally be bonded to an underlying portion utilizing a wide variety of suitable methods and/or techniques. Additionally, as shown, any number of ribs may be formed on the extending portions 220A, 220B.

Figure 2B:
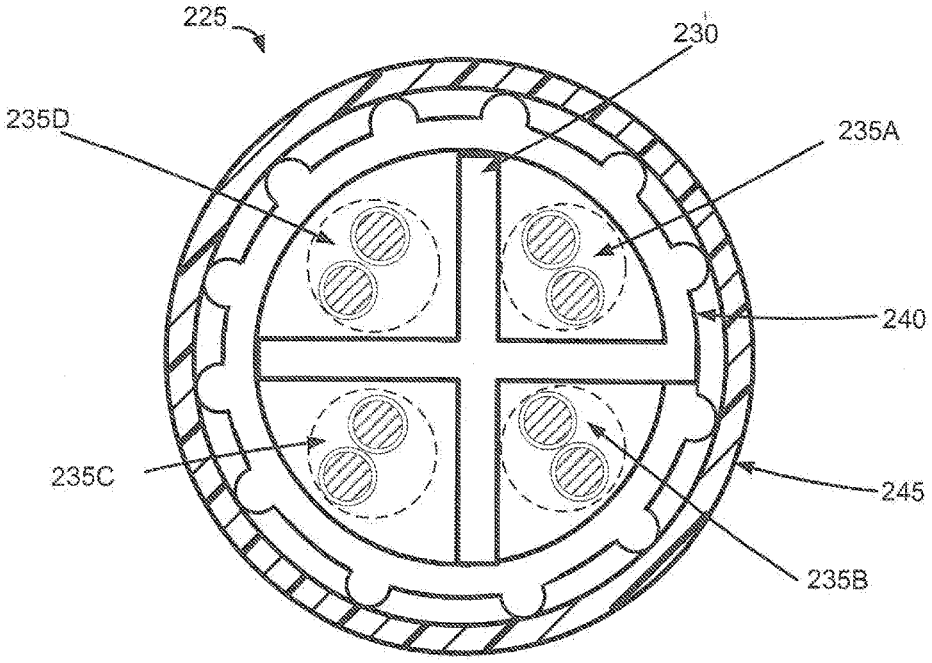

FIG. 2B illustrates an example cable 225 in which a separator 230 positioned between a plurality of twisted pairs 235A-D includes a single extending portion 240, example separator 225 having a single tape includes an extending portion. Much like the separator 100 of FIGS. 1A and 1B, the separator 230 may have an approximately cross-shaped cross-section; however, a single prong may extend beyond and may be wrapped around the outer periphery of the twisted pairs 235A-D. As shown the extending portion 240 may extend approximately 360° around the outer periphery. In other embodiments, the extending portion 240 may extend other desired distances around the outer periphery including distances less than 360° or distances greater than 360°. For example, an extending portion 240 may form a double wrap around the outer periphery. As desired, the extending portion 240 may be bonded to an underlying layer (e.g., itself, one or more twisted pairs, etc.) via any number of suitable methods and/or techniques. Additionally, any number of ribs may be formed on the extending portion 240. Further, as shown, a jacket 245 may be formed around the twisted pairs 235A-D and the separator 230.

Figure 2C:
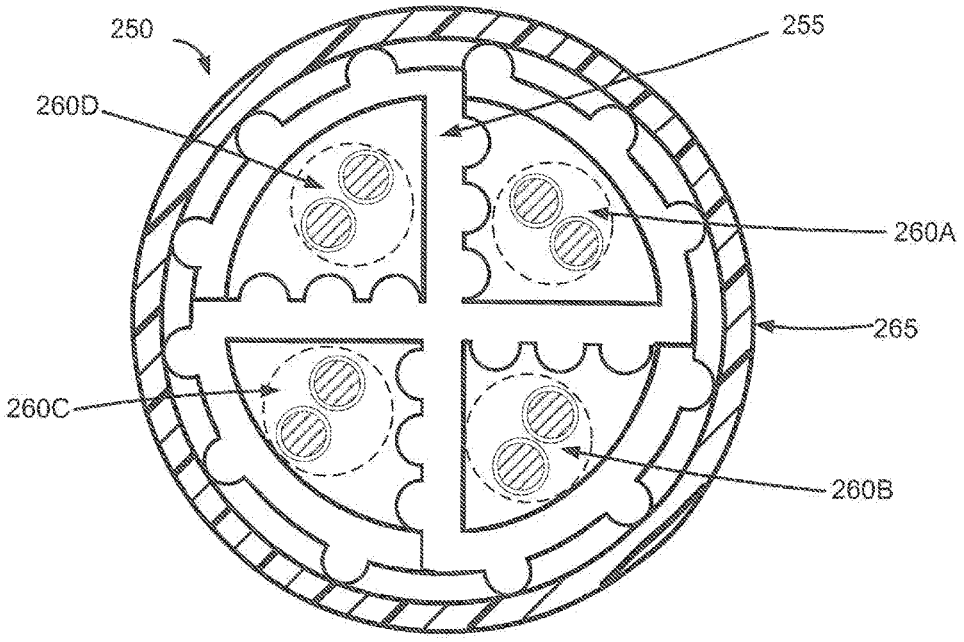

FIG. 2C illustrates another example cable 250 in which a separator 255 may be positioned between a plurality of twisted pairs 260A-D. A jacket 265 may then be formed around the twisted pairs 260A-D and the separator 255. Each of the components of the cable 250 may be similar to those discussed above with reference to FIGS. 1A and 1B. However, in contrast to the separator 100 illustrated in FIGS. 1A and 1B, the separator 255 of FIG. 2C may include ribs formed on both one or more extending portions and on a central portion. For example, the separator 255 may have an approximately cross-shaped cross section with four prongs extending from a central point. For at least one of the prongs, ribs may be formed on both a portion of the prong positioned between two twisted pairs and on a portion of the prong that extends beyond an outer periphery of the twisted pairs.

As a result of incorporating ribs into a central portion of a separator 255, it may be possible to improve crosstalk performance within the cable 250. In certain embodiments, the positioning of ribs between twisted pairs may increase the distance between the pairs, thereby improving crosstalk performance. The use of ribs may also reduce an amount of material necessary to form a separator with the increased separation distance. Additionally, dielectric benefits may be achieved by the presence of air or another gas between adjacent ribs. In other embodiments, a base portion on which the ribs are formed may be reduced such that the overall thickness of the central portion including the base portion and the ribs is similar to that of a conventional separator. In such a design, improved dielectric performance may be achieved as a result of air or another gas positioned between adjacent ribs.

In certain embodiments, one or more ribs formed on an extending portion may have similar dimensions (e.g., cross-sectional shapes, thicknesses, etc.) to one or more ribs formed on a central portion. In other embodiments, a rib formed on an extending portion may have at least one dimension that is different than a rib formed on a central portion. For example, a central portion rib may have a different cross-sectional shape than a rib formed on an extending portion. As another example, a central portion rib may be formed with a different thickness than an extending portion rib. Additionally, as desired in various embodiments, ribs may be formed on one or both sides of a central portion element, such as one of the central portion prongs illustrated in FIG. 2C.

Figure 2D:
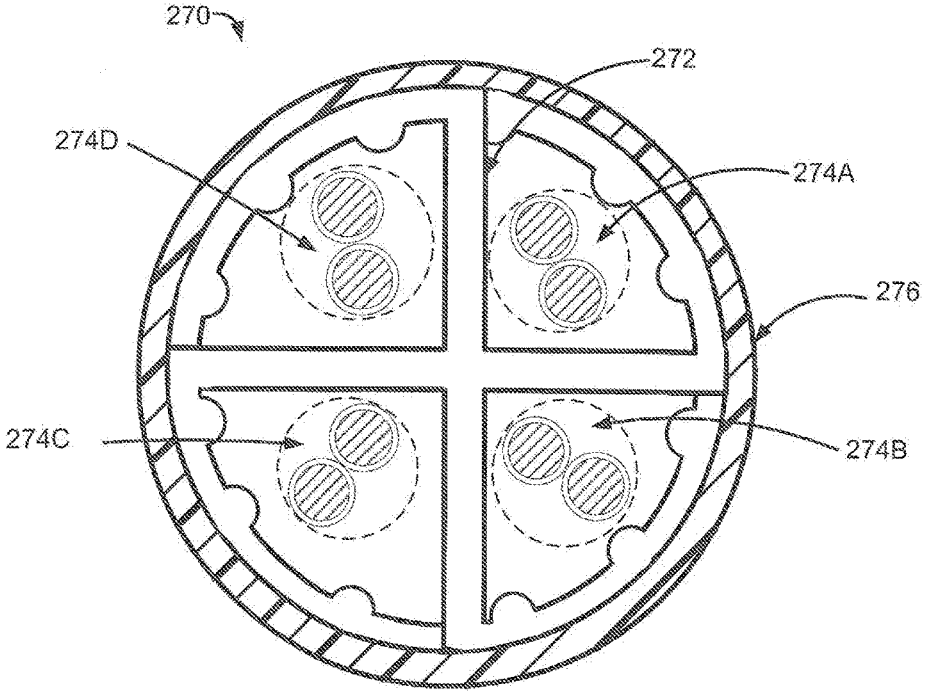

FIG. 2D illustrates another example cable 270 in which a separator 272 may be positioned between a plurality of twisted pairs 274A-D. A jacket 276 may then be formed around the twisted pairs 274A-D and the separator 272. Each of the components of the cable 270 may be similar to those discussed above with reference to FIGS. 1A and 1B. However, the ribs in FIG. 2D are formed on an opposite surface or side of the extending portion(s) than those depicted in FIGS. 1A and 1B. In particular, the separator 100 of FIGS. 1A and 1B includes ribs 130 that extend from the one or more extending portions 125A-D towards the outer jacket 115 of the cable 100. These ribs 130 may be characterized as being formed on an outer surface of the extending portion(s) 125A-D once the extending portion(s) 125A-D are wrapped around an outer periphery of the twisted pairs 105A-D. By contrast, the separator 272 of FIG. 2D includes ribs that extend from the one or more extending portions towards the twisted pairs 274A-D of the cable 2700. These may be characterized as being formed on an inner surface of the extending portion(s) once the extending portion(s) are wrapped around an outer periphery of the twisted pairs 274A-D.

Figure 2E:
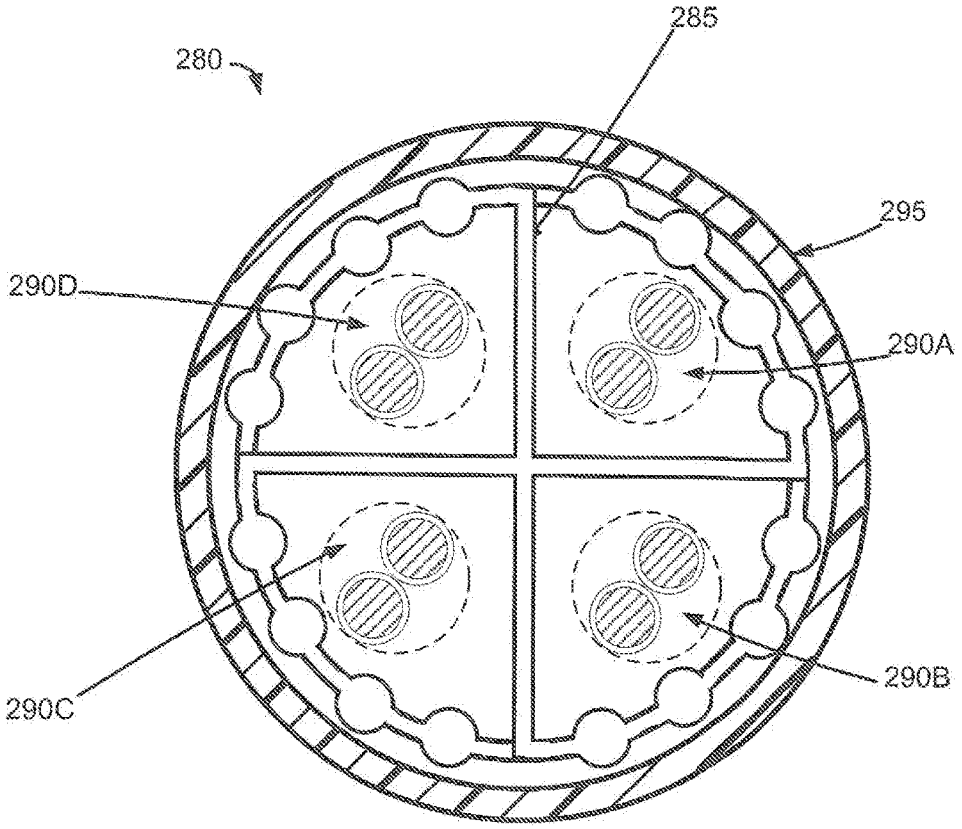

FIG. 2E illustrates an example cable 280 in which a separator 285 includes ribs formed on both an inner surface and an outer surface of one or more extending portions. In other words, first ribs may be formed that extend towards the twisted pairs 290A-D when one or more extending portions are wrapped or curled around an outer periphery of the twisted pairs 290A-D. Second ribs may also be formed that extend towards an outer jacket 295 when the one or more extending portions are wrapped around the outer periphery of the twisted pairs. Indeed, a wide variety of suitable extending portion and/or rib configurations may be incorporated into a separator as desired. The configurations illustrated in FIGS. 2A-2E are provided by way of non-limiting example only.

As set forth above, ribs and/or thickness variations may be formed with a wide variety of suitable dimensions, such as a wide variety of suitable cross-sections, thicknesses, widths, etc. FIGS. 3A-E are cross-sectional views of example ribs or thickness variations that may be incorporated into separator structures, according to illustrative embodiments of the disclosure. Any of the separators discussed herein may be constructed with any of the example ribs and/or thickness variations illustrated in FIGS. 3A-E, as well as a large variety of other suitable configurations. Additionally, the example ribs and/or thickness variations may be incorporated into a wide variety of suitable portions of a separator, such as a central portion and/or one or more extending portions.

Figure 3A:
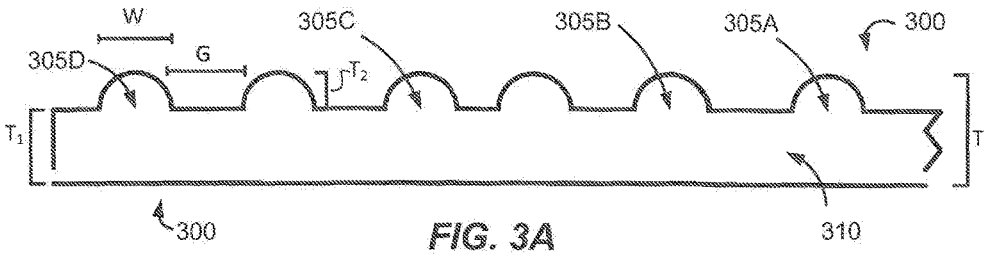
FIGS. 3A-E are cross-sectional views of example ribs or thickness variations that may be incorporated into separator structures, according to illustrative embodiments of the disclosure.

Turning first to FIG. 3A, a cross-sectional view of a first example separator section 300 is illustrated. A plurality of ribs 305A-D may extend from a surface of the section 300. For example, the ribs 305A-D may extend from a surface of a base portion 310 of the section 300. As shown the ribs 305A-D may have a convex, arcuate, or semi-circular cross-sectional shape. Additionally, as described in greater detail above with reference to FIGS. 1A and 1B, each rib (generally referred to as rib 305) may have a wide variety of suitable dimensions. For example, each rib 305 may have any suitable width "W", such as a width that it occupies along a surface of the separator 300 or a width that it occupies along an outer periphery of a plurality of twisted pairs. Additionally, any suitable separation distance or gap "G" may be present between adjacent ribs.

With continued reference to FIG. 3A, the base portion of the section 300 may have any suitable thickness "$T_1$", and each rib 305 may have any suitable thickness "$T_2$". As a result, the section 300 may have any suitable overall thickness "T". In certain embodiments, the overall thickness "T" may correspond to a desired separation distance between a plurality of twisted pairs associated with a separator and another component of a cable, such as an outer jacket formed around the twisted pairs and the separator.

Figure 3B:
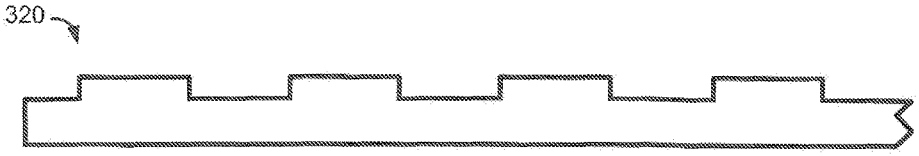
Figure 3C:
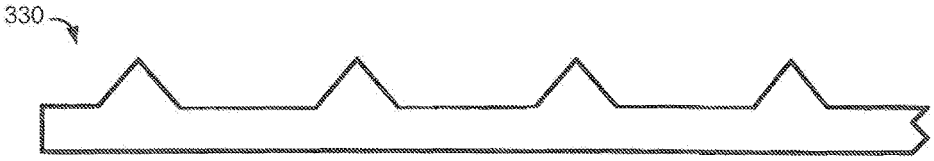
Figure 3D:
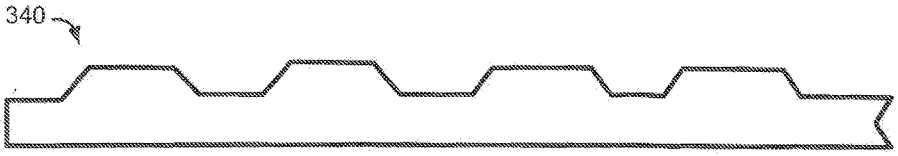

FIG. 3B illustrates a cross-sectional view of an example separator section 320 that includes a plurality of ribs having rectangular cross-sections. FIG. 3C illustrates a cross-sectional view of an example separator section 330 that includes a plurality of ribs having triangular cross-sections. FIG. 3D illustrates a cross-sectional view of an example separator section 340 that includes a plurality of ribs having trapezoidal cross-sections. Much like the section 300 of FIG. 3A, the various components of the separator sections 320, 330, 340 may be formed with a wide variety of suitable dimensions. Additionally, a wide variety of other suitable rib designs and/or constructions may be incorporated into separators. For example, ribs may be formed that are narrower at their base (e.g., an attachment point to a base portion of a separator) and that flare out or get wider as they extend from the base.

Figure 3E:
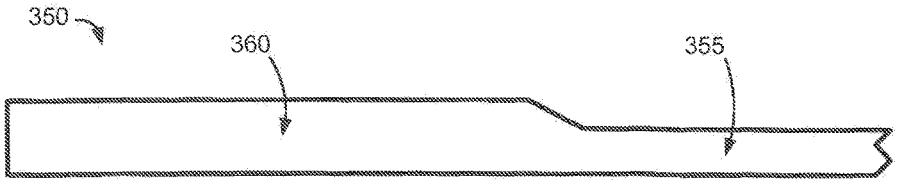

FIG. 3E illustrates a cross-sectional view of an example separator section 350 that includes a first portion 355 having a first thickness and a second portion 360 having a second thickness greater than the first thickness. In other words, the separator section 350 may be characterized as having a single rib or thickness variation. In one example embodiment, the separator section 350 may represent a prong of a separator. The first portion 355 may be a portion of the prong positioned between a plurality of twisted pairs, and the second portion may be an extending portion of the prong that is wrapped at least partially around an outer periphery of the twisted pairs. The second thickness may permit a desired separation between the twisted pairs and another component of a cable, such as an outer jacket.

As described in greater detail above, ribs may be formed on a separator surface in a wide variety of different directions and/or with a wide variety of suitable configurations. FIGS. 4A-C are top level views of example rib variations that may be utilized in association with separator structures, according to illustrative embodiments of the disclosure. For example, these example rib variations may be utilized in conjunction with any of the separator structures discussed herein. FIG. 4A illustrates a top level view of a separator surface 400 that may extend in a longitudinal direction "L". The longitudinal direction "L" may be parallel to the direction to the longitudinal direction of the twisted pairs incorporated into a cable. The separator surface may be any suitable surface of a separator, such as a top or bottom surface of an extending portion or a surface of a central portion. Any number of ribs, such as ribs 405A, 405B, may be formed on the surface as desired. In certain embodiments, and as shown in FIG. 4A, the ribs 405A. 405B may also extend in the longitudinal direction "L". In other words, the ribs 405A, 405B may extend in a direction that is parallel to the longitudinal direction of the twisted pairs.

FIG. 4B illustrates a top level view of another example separator surface 410 that may extend in a longitudinal direction "L" that is parallel to the longitudinal direction of the twisted pairs. However, as shown, one or more ribs 415A-C may be formed on the separator surface 410 at an angle with respect to the longitudinal direction "L". The ribs 415A-C may be formed at an angle relative to the longitudinal direction, for example, at an acute angle or at an angle that is perpendicular to the longitudinal direction "L". In various embodiments, ribs 415A-C may be formed an angle with respect to the longitudinal direction "L" of approximately 20°, 25°, 30°, 35°, 40°, 45°, 50°, 55°, 60°, 65°, 70°, 75°, 80°, 85°, 90°, an angle included in a range between any two of the above values, or an angle included in a range bounded on either a minimum or maximum end by one of the above values.

In certain embodiments, ribs may be relatively continuous along a surface of a separator. In other embodiments, one or more ribs may include a plurality of spaced discontinuous segments or portions. FIG. 4C illustrates a top level view of an example separator surface 420 on which a plurality of ribs having discontinuous sections may be formed. The separator surface 420 may extend in a longitudinal direction "L" that is parallel to the longitudinal direction of the twisted pairs. As shown, each rib formed on the separator surface 420 may include a plurality of discrete and/or discontinuous sections that are spaced along its length. For example, a first rib may include a first plurality of spaced sections or portions 425A-C. and a second rib may include a second plurality of spaced sections or portions 430A-C.

As shown, the ribs of FIG. 4C may extend in the longitudinal direction "L". In other embodiments, ribs may be formed at an angle with respect to the longitudinal direction "L". Additionally, as desired, each rib section may have any suitable dimensions, such as any suitable length and/or width. For example, each rib section may have a length of approximately 0.01, 0.03, 0.05, 0.1, 0.3, 0.5, 0.75, 1.0, 1.5, 2.0, 2.5, 3.0, 3.5, 4.0, 4.5, 5.0, 7.0, 10.0, 20.0 meters, a length included in a range between any two of the above values, or a length included in a range bounded on either a minimum or maximum end by one of the above values. Additionally, a gap or space between adjacent ribs and/or adjacent rib sections may have any suitable dimensions. As desired, a gap may be sized such that a minimum space is maintained between the twisted pairs and another cable component, such as a jacket. For example, the gap may be sized such that a portion of the outer jacket and/or an adjacent cable is not permitted to be positioned within the gap in such a way that increased alien crosstalk can occur. As another example, the gap may be sized such that a twisted pair is not permitted to migrate into the gap. In certain embodiments, rib sections may be formed in accordance with a desired pattern having a repeating step. In other embodiments, rib sections may be formed in a random or pseudo-random manner.

As desired, a separator and/or various portions of a separator may also be formed from a wide variety of suitable materials and/or with a wide variety of different layers. FIGS. 1A and 1B illustrate example separators that have a single layer construction. FIGS. 5A-E are cross-sectional views of other example layer and/or material constructions that may be utilized in association with separator structures, according to illustrative embodiments of the disclosure. Turning first to FIG. 5A, a separator 500 (or a separator component) may be formed with a multi-layer construction in various embodiments. Any number of layers may be utilized as desired. As shown, the separator 500 may include a base layer 505 and a second layer 510 formed on the base layer. Any of the layers, such as the second layer 510, may include one or more ribs or thickness variations. In certain embodiments, the plurality of layers 505, 510 may be formed from similar materials and/or groups of materials. In other embodiments, at least two layers of the separator 500 may be formed from different materials.

Figure 5B:
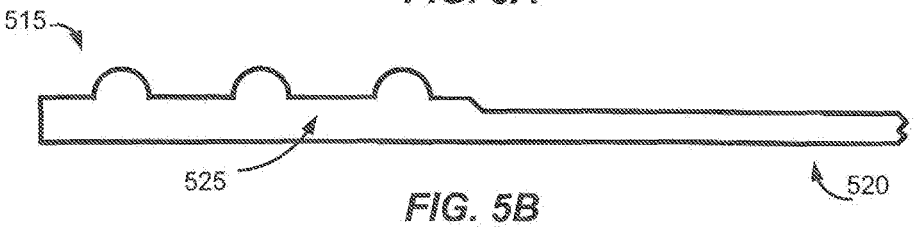

FIG. 5B illustrates an example separator structure 515 in which a first portion or section 520 of the separator has a first thickness and a second portion or section 525 of the separator has a second thickness. In one example configuration, the first portion 520 may be a portion of the separator 515 positioned between a plurality of twisted pairs, and the second portion 525 may be a portion that is wrapped around an outer periphery of the twisted pairs. As desired, any number of ribs may be formed on the first portion 520 and/or the second portion 525. As shown, a plurality of ribs are formed on a surface of the second portion 525. Additionally, each of the sections 520, 525 may be formed with any number of suitable layers and/or from any suitable materials.

Figure 5C:
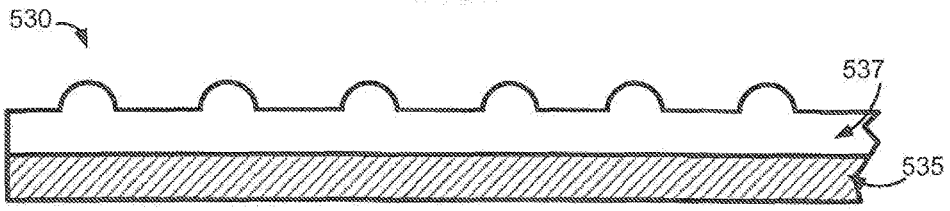
Figure 5D:
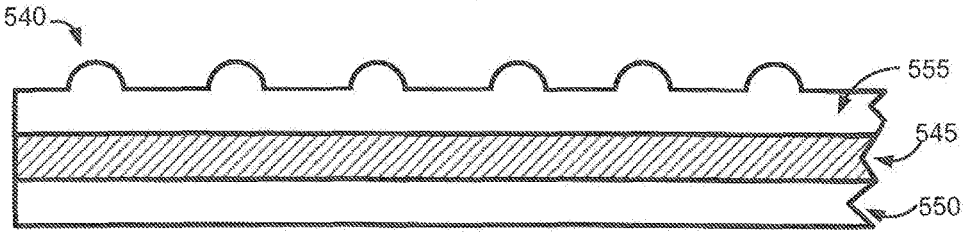
Figure 5E:
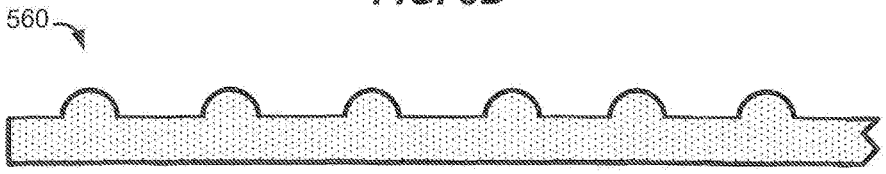

FIGS. 5C-E illustrate example separator structures that incorporate shielding material. For example, FIG. 5C illustrates an example separator structure 530 that includes a layer 535 of shielding material attached to a layer of dielectric material 537. FIG. 5D illustrates an example separator structure 540 in which a layer 545 of shielding material is positioned between or "sandwiched" between two layers 550, 555 of dielectric material. FIG. 5E illustrates an example separator structure 530 in which a separator (or one or more separator components) are formed from a shielding material. A wide variety of other suitable separator constructions that incorporate shielding material may be formed as desired. Indeed, a separator may be formed with any suitable construction, number of layers, and/or from any number of suitable materials.

As set forth above, the central portion of a separator may be formed with a wide variety of suitable cross-sectional shapes. For example, the example separators illustrated in FIGS. 1A-2E may have a central portion with an approximately cross or plus-shaped cross-sectional shape. FIGS. 6A-C are cross-sectional views of other example separator structures that may be incorporated into cables, according to illustrative embodiments of the disclosure. FIG. 6A illustrates an example separator 600 in which a central portion may have a relatively flat shape. The central portion may be positioned between two or more of the twisted pairs of a cable. For example, the central portion may be positioned within the cable in order to bisect (or otherwise divide) a cable core, and two twisted pairs may be disposed on either side of the central portion. Any number of extending portions may extend from the central portion, and the extending portion(s) may be wrapped around an outer periphery of the twisted pairs. Ribs may also be formed on the extending portion(s) and/or on the central portion as desired.

FIG. 6B illustrates an example separator 610 having a central portion with an approximately T-shaped cross-section. The central portion may include a first portion or segment that bisects (or otherwise divides) a cable core, thereby forming two channels in which twisted pairs are disposed. For example, two twisted pairs can be disposed in a first channel and an additional two twisted pairs can be disposed in a second channel. Additionally, the central portion may include a second portion connected at one end of the first portion at an approximately 90 degree angle. In certain embodiments, the first portion may contact the second portion at an approximate midpoint of the second portion. In other embodiments, the connection may be offset from a midpoint of the second portion. Additionally, as desired, the first portion may extend through the second portion any desired distance. The second portion may be configured to contact the outer jacket of a cable (or any intermediate shielding or other layer) and may assist in holding the separator 610 in place. As desired, the separator 650 may include any number of longitudinal channels. Further, the separator 610 may include any number of extending portions and any number of ribs and/or thickness variations.

FIG. 6C illustrates an example separator 620 in which one or more longitudinally extending channels 625 or longitudinal channels are formed through the central portion. In certain embodiments, a longitudinal channel 625 may assist in temperature normalization and/or cooling of a cable. Additionally, as desired, one or more transmission media (e.g., optical fibers, etc.), heat sinks, and/or other components may be positioned within a longitudinal channel. Central portions may be formed with a wide variety of other suitable cross-sectional shapes and/or dimensions as desired in various embodiments. The constructions illustrated in FIGS. 6A-C are provided by way of non-limiting example only.

As set forth above, in certain embodiments, shielding material may be incorporated into a separator. A wide variety of different shielding configurations and/or arrangements of shielding material may be utilized in conjunction with separators, such as any of the separators illustrated in FIGS. 1A-6C. FIGS. 7A-7G illustrate top level views of example shielding material configurations that may be utilized in various embodiments. With reference to FIG. 7A, an example separator 700 (or separator component or layer) may include relatively continuous shielding material 705. For example, a continuous patch of shielding material may be formed on a dielectric layer. As another example, a separator 700 may be formed from a shielding material or impregnated with shielding material along its entire length.

With reference to FIG. 7B, a top level view of another example separator 710 is illustrated. The separator 710 may include any number of rectangular patches of shielding material, such as patches 715A-D formed on a dielectric material or otherwise incorporated into the separator. As desired in various embodiments, the patches 715A-D may include any desired lengths, and any desired gap 720 or separation distance may be provided between adjacent patches. In certain embodiments, the patches may be formed in accordance with a repeating pattern having a definite step or period. As desired, additional patches may be formed on an opposing side of the dielectric material to cover the gaps 720.

Figure 7D:
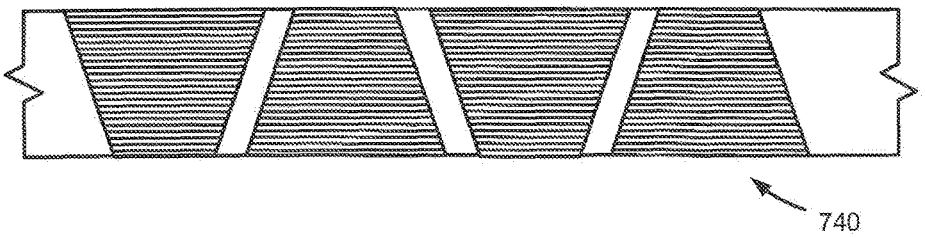

FIG. 7C illustrates a top level view of another example separator 730. The separator 730 may include any number of patches of shielding material having the shape of a parallelogram. In other words, the patches may be formed at an angle within one or more areas of the separator 730. For example, the patches may be formed at an acute angle with respect to the width dimension of the illustrated surface of the separator 730. In certain embodiments, the acute angle facilitates manufacturing and/or enhances patch-to-substrate adhesion. Additionally, the acute angle may also facilitate the covering of opposing isolating spaces or gaps. In certain embodiments, benefit may be achieved when the acute angle is about 45 degrees or less. In other embodiments, benefit is achieved when the acute angle is about 35 degrees or less, about 30 degrees or less, about 25 degrees or less, about 20 degrees or less, or about 15 degrees or less. In other embodiments, benefit is achieved when the acute angle is between about 12 and about 40 degrees. In certain embodiments, the acute angle may be in a range between any two of the degree values provided in this paragraph or a range bounded on a minimum or maximum end by one of the provided values. FIG. 7D illustrates a top level view of another example separator 740 that may be utilized in various embodiments. The separator 740 may include any number of patches of shielding material having a trapezoidal shape. In certain embodiments, the orientation of adjacent trapezoidal patches may alternate. Similar to the patch pattern illustrated in FIG. 7C, the trapezoidal patches may provide manufacturing and/or shielding benefits.

Figure 7E:
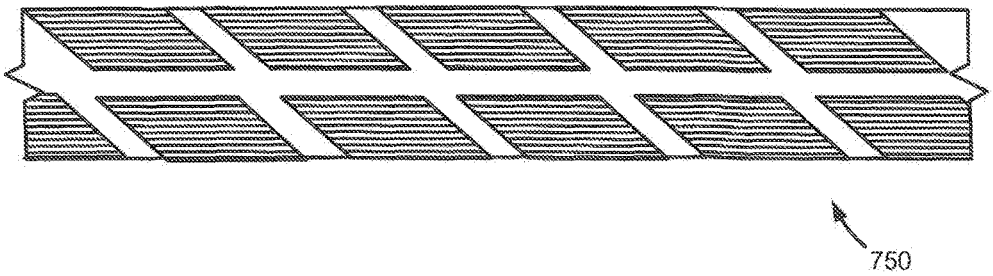

In certain embodiments, patches of shielding material may be formed across a dimension of a separator, such as across a width dimension that is perpendicular to a longitudinally extending direction of the separator. In other embodiments, multiple patches may be formed across a given dimension, such as a width dimension. Similarly, multiple patches may be formed within any given shield layer incorporated into a separator. FIG. 7E illustrates a top level view of an example separator 750 in which multiple patches are formed across a width or other suitable dimension. As desired, patches may be discrete or discontinuous along any dimension of the separator 750 and/or across multiple dimensions (e.g., a width and a length dimension). Additionally, any number of patches may be formed across a given dimension. Each patch may have a wide variety of suitable dimensions (e.g., widths, lengths, etc.), and/or a wide variety of suitable separation gaps may be formed between adjacent patches.

Figure 7F:
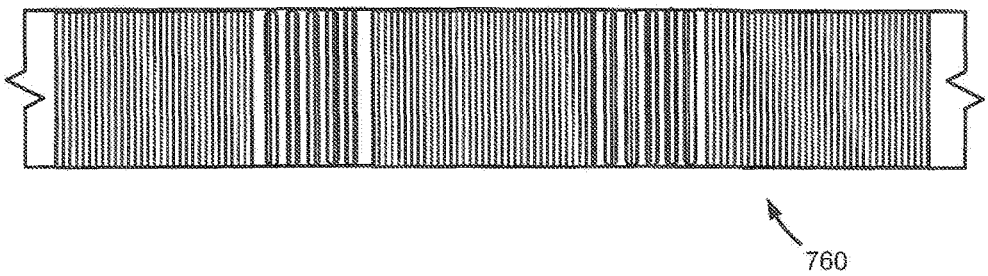

FIG. 7F illustrates a top level view of an example separator 760 in which one or more respective microcuts are utilized to form gaps between adjacent patches of shielding material. In certain embodiments, the width of each of these microcuts may be less than or equal to approximately 0.25 mm. These relatively narrow microcuts may limit the leakage of the shield layer, and therefore, reduce noise during electrical transmission using a cable. In certain embodiments, a series of microcuts may be placed in relatively close proximity to one another. For example, a series of microcuts may be formed as an alternative to a traditional space or gap between patches of shielding material. As one example, a conventional discontinuous shield may include gaps or spaces between adjacent patches that are at least approximately 0.050 inches (approximately 1.27 mm) wide. By contrast, a plurality of relatively narrow or fine microcuts (e.g., microcuts of approximately 0.25 mm, etc.) may be formed in an approximately 0.050 inch wide portion (or any other desired width) of a shield layer. Additionally, it is noted that the use of singular or isolated microcuts within a shield layer may allow electricity to arc across the microcuts, thereby leading to a safety hazard. However, a plurality of microcuts positioned or formed in relatively close proximity to one another may limit safety risks due to electrical arcing. Any electrical arcing across the microcut gaps will likely burn up or destroy the electrically conductive material between the closely spaced microcuts, thereby breaking or severing the electrical continuity of the shield layer and preventing current from propagating down the shield layer. In other words, the microcuts may be spaced and/or formed to result in a shield layer that includes shielding material having a sufficiently low mass such that the shielding material will fuse or melt when current is applied.

Although the examples above describe situations in which conventional spaces or gaps are respectively replaced with a series of microcuts, a wide variety of other suitable configurations of microcuts may be utilized in other embodiments. For example, a shield layer may include microcuts continuously spaced in close proximity to one another along a longitudinal length. In other embodiments, sections or patches of microcuts may be spaced at regular intervals or in accordance with any desired pattern. Each section or patch may include at least two microcuts. A wide variety of suitable patterns may be formed by microcuts. For example, a section of microcuts (e.g., one section of a repeating pattern, etc.) may include microcuts having a perpendicular line pattern, a dashed vertical line pattern, a square pattern, an inverse square pattern, a diamond-shaped pattern, an inverse diamond-shaped pattern, a checkerboard pattern, an angled line pattern, a curved line pattern, or any other desired pattern. As another example, a section of microcuts may include microcuts that form one or more alphanumeric characters, graphics, and/or logos. In this regard, product identification information, manufacturer identification information, safety instructions, and/or other desired information may be displayed on a shield layer. In yet other embodiments, sections or patches of microcuts may be positioned in random locations along a shield layer. Additionally, a wide variety of suitable methods and/or techniques may be utilized to form microcuts. For example, one or more lasers may be utilized to form microcuts.

Figure 7G:
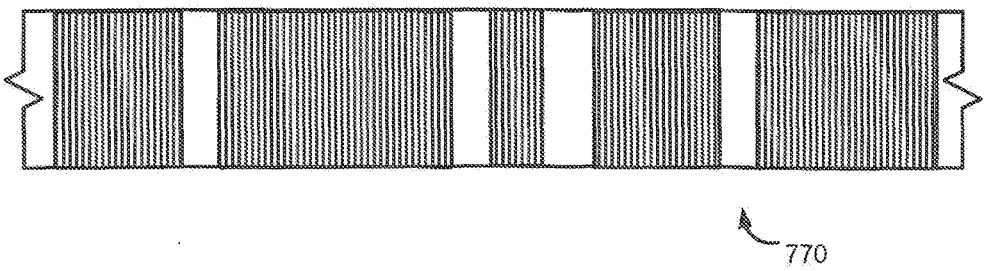

FIG. 7G depicts a top level view of another example separator 770 that may be utilized in various embodiments. The separator 770 may include a plurality of discontinuous patches or sections of shielding material that are formed in a random or pseudo-random manner. A wide variety of other suitable patch configurations and/or other configurations of shielding material may be utilized as desired in other embodiments, and the configurations discussed herein are provided by way of non-limiting example only.

A wide variety of other types of separator structures may be formed as desired in various embodiments. These separators may include any number of layers of material. Additionally, as desired, separators may be formed with a wide variety of suitable dimensions and/or configurations. For example, various components of a separator may have any suitable widths and/or thicknesses. Further, any of the features discussed above for a given separator structure may be incorporated into any of the other separator structures. The separators structures illustrated in FIGS. 1A-6C are provided by way of non-limiting example only.

Example Method for Forming Cables with Separator Structures

Figure 8:
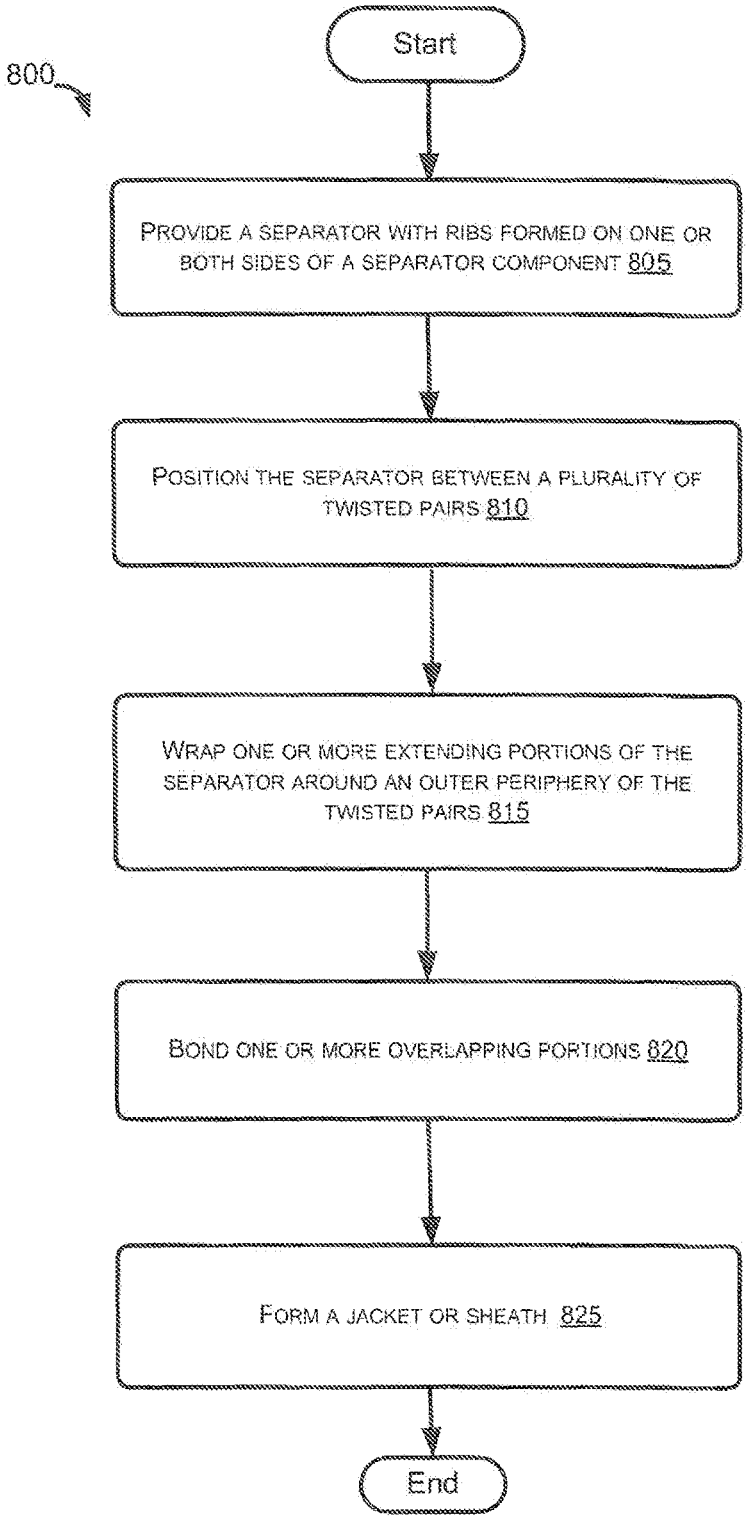
FIG. 8 is a flow diagram illustrating an example method for manufacturing or forming a cable including a separator structure in accordance with various embodiments of the disclosure.

FIG. 8 is a flow diagram illustrating an example method 800 for manufacturing or forming a cable including a separator structure in accordance with various embodiments of the disclosure. The method 800 may begin at block 805. At block 805, a separator may be provided that includes any number of ribs and/or thickness variations. For example, any of the separator structures described above with reference to FIGS. 1A-6C may be provided. According to an aspect of the disclosure, the provided separator structure may include at least one extending portion. Additionally, in certain embodiments, one or more ribs may be formed on at least one surface of an extending portion. In other embodiments, the separator may include a thickness variation between an extending portion and a central portion. For example, an extending portion of a separator prong may be thicker than a portion of the prong to be positioned between two or more twisted pairs.

At block 810, the separator may be positioned between a plurality of twisted pairs. For example, the separator may be positioned between a plurality of twisted pairs, and respective prongs of the separator may extend between adjacent sets of twisted pairs. At block 815, one or more extending portions of the separator may be wrapped or curled around the outer periphery of the twisted pairs. In this regard, a complete or partial outer wrap layer may be formed around the twisted pairs. Additionally, in certain embodiments, one or more overlapping portions may be formed by the tape portions that are wrapped around the twisted pairs. At block 820, which may be optional in certain embodiments, one or more overlapping portions may optionally be bonded or joined to an underlying portion, such as another extending portion, etc.

At block 825, one or more finishing operations may be performed with respect to the twisted pair component that includes the twisted pairs and the separator. A wide variety of suitable finishing operations may be performed as desired in various embodiments. For example, a suitable jacket layer or binder may be formed around the twisted pairs and the separator. As another example, the twisted pair component may be taken up or collected for subsequent incorporation into a cable. As yet another example, the twisted pair component may be provided downstream to a suitable manufacturing component or system that incorporates the twisted pair structure into a cable.

As desired in various embodiments, the method 800 may include more or less operations than those described above with reference to FIG. 8. Additionally, in certain embodiments, any number of the described operations may be carried out or performed in parallel. The described method 800 is provided by way of non-limiting example only.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of longitudinally extending twisted pairs of individually insulated electrical conductors;

a longitudinally extending separator positioned between the plurality of twisted pairs and comprising at least one portion that extends beyond and is wrapped at least partially around an outer periphery of the plurality of twisted pairs such that the at least one extending portion contacts another portion of the separator, wherein a plurality of ribs are formed only on the at least one extending portion of the separator; and a jacket formed around the plurality of twisted pairs and the separator.

2. The cable of claim 1, wherein the plurality of ribs extend in a common direction from a surface of the at least one extending portion.

3. The cable of claim 1, wherein the plurality of ribs comprise at least one of (i) a plurality of longitudinally extending ribs, (ii) a plurality of ribs formed at an angle with respect to a longitudinal direction, or (iii) a plurality of ribs spaced along a longitudinal direction.

4. The cable of claim 2, wherein the plurality of ribs extend from the surface towards the jacket.

5. The cable of claim 1, wherein at least one of the plurality of ribs has one of (i) an approximately rectangular cross-sectional shape, (ii) an approximately convex cross-sectional shape, (iii) an approximately triangular cross-sectional shape, or (iv) an approximately trapezoidal cross-sectional shape.

6. The cable of claim 1, wherein the separator comprises a plurality of extending portions that are each wrapped at least partially around the outer periphery of the plurality of twisted pairs.

7. The cable of claim 1, wherein the separator is formed from one of (i) an extruded polymeric material or (ii) a foamed polymeric material.

8. The cable of claim 1, wherein the separator comprises a central portion and the at least one extending portion extends from the central portion, and wherein the central portion comprises one of (i) an approximately cross-shaped cross-section, (ii) an approximately flat cross-section, or (ii) approximately T-shaped cross-section.

9. The cable of claim 1, further comprising shielding material incorporated into the separator.

10. A cable comprising:

a jacket defining a longitudinally extending cavity;

a plurality of longitudinally extending twisted pairs of individually insulated electrical conductors positioned within the cavity; and a longitudinally extending separator positioned between the plurality of twisted pairs and comprising a plurality of projections, each projection comprising:

a first portion positioned between a respective adjacent set of the plurality of twisted pairs and extending to an outer periphery defined by the adjacent set of the twisted pairs; and a second portion that extends from the first portion beyond the outer periphery of the plurality of twisted pairs and that forms at least a partial outer wrap around the plurality of twisted pairs, wherein each of the second portions comprises a respective plurality of ribs extending in a common direction from a surface of the extending portion, each of the plurality of ribs having a maximum thickness corresponding to a desired separation distance between the jacket and the plurality of twisted pairs, and wherein each of the second portions is wrapped in a single and common direction around the outer periphery of the plurality of twisted pairs.

11. The cable of claim 10, wherein the respective plurality of ribs extend from the one or more extending portions towards the jacket.

12. The cable of claim 10, wherein at least one of the plurality of ribs has one of (i) an approximately rectangular cross-sectional shape, (ii) an approximately convex cross-sectional shape, (iii) an approximately triangular cross-sectional shape, or (iv) an approximately trapezoidal cross-sectional shape.

13. The cable of claim 10, wherein the separator is formed from one of (i) an extruded polymeric material or (ii) a foamed polymeric material.

14. The cable of claim 10, wherein the plurality of projections of the separator comprise one of (i) an approximately cross-shaped cross-section, (ii) an approximately flat cross-section, or (ii) approximately T-shaped cross-section.

15. The cable of claim 10, further comprising shielding material incorporated into the separator.

16. A cable comprising:

a plurality of longitudinally extending twisted pairs of individually insulated electrical conductors;

a longitudinally extending separator comprising:

a central portion positioned between the plurality of twisted pairs and extending between one or more adjacent sets of the plurality of twisted pairs to an outer periphery defined by the plurality of twisted pairs; and a plurality of extending portions that extend from the central portion beyond an outer periphery of the of twisted pairs, wherein the plurality of extending portions are wrapped around the outer periphery in a single and common direction, each of the extending portions comprising a respective plurality of thickness variations, wherein each of the plurality of extending portions contacts another portion of the separator when wrapped around the outer periphery; and a jacket formed around the plurality of twisted pairs and the separator.

17. The cable of claim 16, wherein at least one of the thickness variations has a maximum thickness that corresponds to a desired separation distance between the jacket and the plurality of twisted pairs.

18. The cable of claim 16, wherein at least one of the plurality of extending portions comprises a plurality of ribs extending from a surface of the at least one extending portion.

19. The cable of claim 16, wherein the separator is formed from one of (i) an extruded polymeric material or (ii) a foamed polymeric material.

20. The cable of claim 16, further comprising shielding material incorporated into the separator.

* * * * *